US007862415B1

(12) United States Patent
Ghaly

(10) Patent No.: US 7,862,415 B1
(45) Date of Patent: Jan. 4, 2011

(54) METHOD AND APPARATUS FOR ELECTRONIC PUZZLE DEVICE

(76) Inventor: Nabil N. Ghaly, 14 Longwood Dr., South Huntington, NY (US) 11746

( * ) Notice: Subject to any disclaimer, the term of this patent is extended or adjusted under 35 U.S.C. 154(b) by 1327 days.

(21) Appl. No.: 11/334,788

(22) Filed: Jan. 19, 2006

Related U.S. Application Data

(60) Provisional application No. 60/646,445, filed on Jan. 25, 2005.

(51) Int. Cl.
*A63F 9/24* (2006.01)

(52) U.S. Cl. ..... 463/9

(58) Field of Classification Search ..... 463/9
See application file for complete search history.

(56) References Cited

U.S. PATENT DOCUMENTS

| | | | | |
|---|---|---|---|---|
| 4,817,952 | A * | 4/1989 | Biro et al. | 273/153 S |
| 6,536,766 | B1 * | 3/2003 | Deitch et al. | 273/287 |
| 7,618,313 | B2 * | 11/2009 | Ghaly | 463/9 |
| 2003/0078091 | A1 * | 4/2003 | Brandstetter et al. | 463/20 |
| 2006/0252517 | A1 * | 11/2006 | Walker et al. | 463/25 |

* cited by examiner

*Primary Examiner*—Pierre E Elisca

(57) ABSTRACT

An electronic game, method and apparatus, is disclosed which includes a playfield that is subdivided into a plurality of sectors. Each sector includes one or a plurality of playing positions, and each playing position has an indicator. The device incorporates a plurality of rotation patterns, each of which maps a plurality of indicators on the playfield. The device further incorporates a plurality of indicating states that correspond to a plurality of visual indications. In addition, the device includes a plurality of input control mechanisms to enable a player to activate the rotation patterns. The object of the game is for the player to manipulate the switches in order to transform an initial pattern of visual indications to a desired pattern of visual indications. The device functions by rotating the indicating states between the various sectors on the playfield using predefined rotation patterns. As an indicating state is shifted, or rotated, from one sector to another, it provides a different visual indication. The device employs a microprocessor to control the progress of the game, monitor the activation of the input switches, rotate the indicating states between indicators defined by a rotation pattern, and generate visual indications based on the configuration of indicating states and sectors. The microprocessor also controls the generation of audio/visual effects to enhance the enjoyment of play. Further, the device employs means to generate a plurality of puzzles, and games, and provisions to vary the level of difficulty of play.

36 Claims, 38 Drawing Sheets

CUBE LED DEVICE

SPHERE LED DEVICE

4x4 LED DEVICE

2x2 LED DEVICE

6x6 LCD DEVICE

VISUAL INDICATION CHART FOR 2 SECTORS & 2 INDICATING STATES PROVIDING 2 VISUAL INDICATIONS (COLORS OR IMAGES)

VISUAL INDICATION CHART FOR 3 SECTORS & 3 INDICATING STATES PROVIDING 3 VISUAL INDICATIONS (COLORS OR IMAGES)

VISUAL INDICATION CHART FOR 4 SECTORS & 4 INDICATING STATES
PROVIDING 4 VISUAL INDICATIONS (COLORS OR IMAGES)

| VISUAL INDICATON | DESIGNATION |
|---|---|
| 1 | |
| 2 | |

VISUAL INDICATION CHART FOR 4 SECTORS & 4 INDICATING STATES PROVIDING 2 VISUAL INDICATIONS (COLORS OR IMAGES)

BINARY REPRESENTATION OF INDICATION CHART FOR 4 SECTORS & 4 INDICATING STATES, PROVIDING 4 VISUAL INDICATIONS (COLORS OR IMAGES) – TRUTH TABLE FOR EXCLUSIVE OR BOOLEAN FUNCTION

VISUAL INDICATION CHART FOR 5 SECTORS & 5 INDICATING STATES PROVIDING 5 VISUAL INDICATIONS (COLORS OR IMAGES)

VISUAL INDICATION CHART FOR 6 SECTORS & 6 INDICATING STATES PROVIDING 6 VISUAL INDICATIONS (COLORS OR IMAGES)

VISUAL INDICATION CHART FOR 7 SECTORS & 7 INDICATING STATES

PROVIDING 7 VISUAL INDICATIONS (COLORS OR IMAGES)

| INDICATING STATE / SECTOR | 1 | 2 | 3 | 4 | 5 | 6 | 7 | 8 |
|---|---|---|---|---|---|---|---|---|
| A | | | | | | | | |
| B | | | | | | | | |
| C | | | | | | | | |
| D | | | | | | | | |
| E | | | | | | | | |
| F | | | | | | | | |
| G | | | | | | | | |
| H | | | | | | | | |

| VISUAL INDICATON | LABEL |
|---|---|
| 1 | |
| 2 | |
| 3 | |
| 4 | |
| 5 | |
| 6 | |
| 7 | |
| 8 | |

VISUAL INDICATION CHART FOR 8 SECTORS & 8 INDICATING STATES PROVIDING 8 VISUAL INDICATIONS (COLORS OR IMAGES)

Figure – 14 -

SECTOR CONFIGURATION FOR 2X2 EMBODIMENT

USING TWO SECTORS

ALTERNATE SECTOR CONFIGURATION FOR 2X2 EMBODIMENT USING FOUR SECTORS

SECTOR CONFIGURATION FOR 3X3 EMBODIMENT

USING THREE SECTORS

SECTOR CONFIGURATION FOR 4X4 EMBODIMENT

USING FOUR SECTORS

| | | | |
|---|---|---|---|
| A | A | B | B |
| A | A | B | B |
| C | C | D | D |
| C | C | D | D |

FIRST ALTERNATE SECTOR CONFIGURATION FOR 4X4 EMBODIMENT USING FOUR SECTORS

Figure – 19 -

SECOND ALTERNATE SECTOR CONFIGURATION FOR 4X4 EMBODIMENT, USING FOUR SECTORS

| | | | | |
|---|---|---|---|---|
| A | E | D | C | B |
| B | A | E | D | C |
| C | B | A | E | D |
| D | C | B | A | E |
| E | D | C | B | A |

SECTOR CONFIGURATION FOR 5X5 EMBODIMENT

USING FIVE SECTORS

Figure – 21 -

SECTOR CONFIGURATION FOR 6X6 EMBODIMENT USING SIX SECTORS

| | | | | | | |
|---|---|---|---|---|---|---|
| A | A | A | A | A | A | A |
| B | B | B | B | B | B | B |
| C | C | C | C | C | C | C |
| D | D | D | D | D | D | D |
| E | E | E | E | E | E | E |
| F | F | F | F | F | F | F |
| G | G | G | G | G | G | G |

SECTOR CONFIGURATION FOR 7X7 EMBODIMENT

USING SEVEN SECTORS

Figure – 23 -

| | | | | | | | |
|---|---|---|---|---|---|---|---|
| A | A | B | B | C | C | D | D |
| A | A | B | B | C | C | D | D |
| E | E | F | F | G | G | H | H |
| E | E | F | F | G | G | H | H |
| A | A | B | B | C | C | D | D |
| A | A | B | B | C | C | D | D |
| E | E | F | F | G | G | H | H |
| E | E | F | F | G | G | H | H |

SECTOR CONFIGURATION FOR 8X8 EMBODIMENT

USING EIGHT SECTORS

Figure – 24 -

EXAMPLE OF A SQUARE ROTATION PATTERN

EXAMPLE OF A RECTANGULAR ROTATION PATTERN

EXAMPLE OF CIRCULAR ROTATION PATTERNS

EXAMPLE OF FIGURE-EIGHT ROTATION PATTERN

EXAMPLE OF A ROTATION PATTERNS CONFIGURATION SET FOR A 6X6 EMBODIMENT

| VISUAL INDICATON | LABEL |
|---|---|
| 1 | |
| 2 | |

| INDICATING STATE / SECTOR | 1 | 2 | 3 | 4 | 5 | 6 |
|---|---|---|---|---|---|---|
| A | | | | | | |
| B | | | | | | |
| C | | | | | | |
| D | | | | | | |
| E | | | | | | |
| F | | | | | | |

VISUAL INDICATION CHART FOR 6 SECTORS & 6 INDICATING STATES PROVIDING 2 VISUAL INDICATIONS (COLORS OR IMAGES)

Figure – 30 -

SWITCH CONFIGURATION FOR ONE SIDE OF CUBE DEVICE SHOWING VARIOUS DIRECTIONS OF SWITCH ACTIVATION

EXAMPLE OF ROTATION PATTERNS CONFIGURATION SET FOR AN 8X8 EMBODIMENT

METHOD AND APPARATUS FOR ELECTRONIC PUZZLE DEVICE

PARENT CASE TEXT

This utility application benefits from provisional application of U.S. Ser. No. 60/646,445, filed on Jan. 25, 2005.

BACKGROUND OF THE INVENTION

1. Field of the Invention

This invention relates generally to electronic hand held games and in particular to an electronic puzzle, wherein the field of play consists of a plurality of playing positions that are mapped on the surface of the puzzle device, and wherein each playing position includes an indicator. The field of play is divided into sectors, each of which includes one or a plurality of indicators. Further, a sector could be a segment of a two-dimensional array of indicators, a side of a three-dimensional field of play, such as a cube, or a segment of a play field mapped on the surface of a three-dimensional spherical shape, such as a sphere, an egg or a cone. Furthermore, each indicator could assume a plurality of indicating states, and each indicating state is represented by one, or a plurality of visual indications, such as images or colors. The puzzle device, also, includes a plurality of control points to enable a player to manipulate the states of the indicators. The control points include switches located on the field of play, however, it is not necessary to have a control point at each playing position.

It is possible, by manipulating the controls in a particular manner or pattern, and by observing the resulting effect on the indicators, to determine a pattern of control activation's which results in the sectors of indicators attaining different indicating states, such that all the indictors belonging to a sector reach an identical indicating state. Because each indicating state is represented by one, or a plurality of colors or images, it is possible to provide a game objective, wherein all the indicators on the play field indicate the same color or image, or in the alternative a game objective wherein each sector displays a different color or image, i.e., a different visual indication.

Various puzzles are known wherein a plurality of playing pieces of various colors are connected together in a geometric shape, and are manipulated by the player so that pieces of the same color are grouped together. However, these puzzles involving the grouping of multiple color pieces are of mechanical designs, and to the inventor's knowledge have not been implemented by "state of the art" electronics, i.e., integrated circuits, microprocessors, etc., which are presently available. An example of such mechanical puzzles is the Rubik Cube, which employs six different colors. Therefore, it is desirable to provide an electronic puzzle device, capable of operating with many color configurations ranging from a minimum of two colors to three, four, five, six, seven, eight, or more colors, and with a versatile game objective that includes attaining a single color or image at all indicators, attaining a different color or image at each sector or subset of indicators, and/or attaining other predefined patterns of colors or images.

2. Description of the Related Art

During the last ten years, a number of patents have been issued related to electronic handheld puzzles that employ a field of play divided into a plurality of playing positions, and wherein each playing position includes a switch and an indicator. These patents include U.S. Pat. Nos. 5,286,037; 5,417,425; 5,564,702; 5,573,245, and 5,603,500. However, with the exception of U.S. Pat. No. 5,286,037, the remaining patents relate to indicators that are limited to only two indicating states, and require a logical element at each playing position that defines a fixed geometric relationship between a switch and a group of indicators. The puzzles described by these patents suffer from a limited number of colors, and need a controlling switch at each playing position. Also, while the device described in U.S. Pat. No. 5,286,037 provides additional colors, and a dynamic variable relationship between switches and indicators, such relationship is not obvious to the player, and each playing position requires a logical element defined as the "routing square" to create a dynamic relationship between switches and indicators.

The present invention overcomes the limitations of the prior art. It does not require a switch at each playing position, and it does not require a logical element to define a fixed or dynamic geometric relationship between switches and indicators. Further, the present invention provides an increased number of colors or images playable by the puzzle device than can be provided by the prior art. Such increase in the number of colors or images is accomplished without a corresponding increase in complexity.

OBJECT OF THE INVENTION

One object of the current invention is to provide a versatile electronic puzzle that can be implemented using a two-dimensional array of indicators, or a plurality of indicators mapped on the surface of a three-dimensional shape.

Another object of the invention is to provide an electronic puzzle device that operates with many color configurations or images ranging from a minimum of two colors or images to a maximum number of colors or images limited by the number of playing positions on the playfield.

It is a further object of this invention to provide an electronic puzzle device wherein the number of colors or images playable by the device could be increased without a corresponding increase in the complexity of the device.

It is also an object of the present invention to provide an electronic puzzle device that does not require a switch at each playing position.

It is another object of the present invention to provide an electronic puzzle device with a game objective to reach a final game state in which groups of indicators are in different indicating states.

It is a further object of this invention to provide an electronic puzzle device utilizing a plurality of switches to manipulate the states of indicators, and wherein a player must determine an exact combination of switch's activations, which results in a first predetermined group of indicators indicating a first state, a second predetermined group of indicators indicating a second state, a third predetermined group of indicators indicating a third state, etc.

It is still an object of the present invention to provide an electronic puzzle device utilizing a plurality of indicators each of which may assume a plurality of states, and wherein each state is indicated by a plurality of colors.

It is also an object of this invention to provide an electronic puzzle device utilizing a plurality of indicators each of which may assume a plurality of states, and wherein each state is indicated by a plurality of graphic symbols or images.

It is yet another object of this invention to provide an electronic puzzle device that utilizes a microprocessor to generate a plurality of games.

It is still another object of the present invention to provide an electronic puzzle device, which employs one or more liquid crystal displays whereon a plurality of images is indicated.

It is also another object of the present invention to provide an electronic puzzle device having a three-dimensional housing such as a sphere, a cube, a pyramid, or the like, whereon a plurality of controls and indicators are located, and wherein the objective of the game is to display a plurality of different images on predetermined groups of indicators.

It is still another object of the present invention to provide an electronic puzzle device having a three-dimensional housing that is divided into sides or sectors, wherein a plurality of indicators are mapped into said sides or sectors, wherein each indicator could assume a plurality of indicating states, and wherein each indicating state is represented by a plurality of colors or images.

Further, it is an object of this invention to provide a handheld electronic puzzle device having a field of play that includes a two-dimensional array of playing positions, or a plurality of playing positions mapped on the surface of a three-dimensional shape, and wherein each playing position includes an indicator, and wherein a plurality of control switches are located on the playfield, and wherein the device includes a mechanism to change the indicating states at a group of indicators by rotating or shifting the indicating states along a predefined direction or pattern on the two-dimensional array of indicators, or along a predefined axis of the three-dimensional shape.

It is also an object of this invention to provide a handheld electronic puzzle device, which employs light emitting diode displays, or liquid crystal displays to provide a plurality of visual indications, i.e. colors and/or images.

It is a further object of this invention to provide a handheld electronic puzzle device with puzzles and games in various levels of difficulty.

It is still an object of this invention to provide an electronic puzzle device that can be played as a computer game, a video game, or as a game that can be loaded to a handheld game device, such as Game Boy, or to a handheld consumer electronic device such as a palm pilot, a cell phone, a blackberry, etc.

It is also an object of this invention to provide an electronic puzzle device, which incorporates audible and visual effect to heighten the enjoyment of play.

SUMMARY OF THE INVENTION

Because of the versatility of the general concept described herein, and the very large number of embodiments that can be used to implement this concept, the preferred embodiments are only examples selected out of many thousands of possible embodiments that could be built using the teaching of the specification herein. These embodiments may vary in size, shape, number of sectors, number of indicating states, or number of colors or images. However, they are all based on the principle of rotating or shifting the indicating states of a group of indicators, along a specific direction or pattern, or around an associated axis, in response to a control point activation. This invention, also, employs the novel concept that each indicating state could be represented by a plurality of colors or images, such that when an indicating state is rotated or shifted from one sector to a different sector on the playfield, the indicating state is represented by a different color or image. It should be noted, however, that for certain embodiments, or game features, it is possible to employ the same color or image to represent an indicating state in a plurality of sectors. It should also be noted that the implementation of this concept is not limited to visual indications. A game designer, for example, may elect to build an embodiment that employs audible indicators, and which produces a different tone as an indicating state is rotated from one indicator to another indicator. However, for the remaining part of the specification, and in the interest of being concise, the description is focused on visual indications such as colors or images. It should be clearly understood that such description is directly applicable to embodiments that employ audible indications.

Because the primary control function to manipulate the states of the indicators is based on the shift process, the objects of the invention could be achieved by a playfield that includes a two-dimensional array of indicators, or by a playfield wherein the indicators are mapped on the surface of a three-dimensional shape. What is important is that the playfield is divided into a plurality of sectors such that when a shift process is implemented, the states of the indicators move between the various sectors. For example, if a two-dimensional playfield is used, the shift control function could be performed along a column or row of indicators with a wrap around feature. The shift control function could also be performed as a rotation around a loop of indicators forming a geometric pattern on the playfield, such as a square, rectangle, circle, star, figure eight, or the like. Alternatively, when a three-dimensional shape is used, the shift process could consist of the rotation of the states of a group of indicators around a corresponding axis of the three-dimensional shape. The shift process could also be performed as a rotation around a loop of indicators forming a geometric pattern on the playfield, such as a square, rectangle, circle, figure eight, or the like. Such a geometric pattern could span one or a plurality of sides or planes of a three-dimensional shape.

The examples provided for the preferred embodiments include two-dimensional arrays of indicators with playfields that employ 2×2, 3×3, 4×4, 5×5, 6×6, 7×7 and 8×8 indicators, as well as three-dimensional embodiments. The three-dimensional examples include a cube having nine (9) indicators on each of its six sides, and a sphere having twelve (12) indicators mapped on its surface. In each of these preferred embodiments, the playfield is divided into a plurality of sectors, and each sector includes one or a plurality of indicators. For example, a 2×2 embodiment includes 4 sectors each of which consists of a single indicator. Similarly, a 4×4 embodiment includes 4 sectors. However, each of the sectors in this embodiment includes 4 indicators. The cube example has six sectors represented by the six sides of the cube, and each sector has nine indicators. On the other hand, the sphere example has four sectors with three indicators per sector.

Each embodiment is defined by the outside shape of the device, the number of playing positions, the location of switches on the playfield, the type of display, i.e. LED, LCD, etc., the maximum number of colors or images' provided by the device, and the rotation or shift patterns implemented in the device.

Further, each puzzle is defined by four main design parameters. The number of sectors on the playfield, the number of indicators per sector, the number of indicating states, and the number of colors or images playable by the puzzle. Additional design parameters for a puzzle include the configuration of the sectors on the playfield, i.e., the mapping of indicators to sectors; the configuration of rotation patterns, and the specific colors or images used.

Furthermore, each game in a puzzle is defined by an initial game state that presents an initial display of colors or images to a player, and a game objective in the form of the final desired display of colors or images. The initial display is produced by an initial assignment of indicating states to playing positions. Accordingly, each embodiment could provide one or a plurality of puzzles, and each puzzle could provide one or a plurality of games.

A plurality of indicating states is used to activate the indicators. One of the main features of the current invention is the novel concept that when an indicating state is shifted or rotated from one sector to a different sector it is represented by a different color or image. Further, the same color or image could represent different combinations of sectors and indicating states. For example, the color "red" could represent the combination of indicating state "1" and sector "A," as well as indicating state "2" and sector "B." Similarly, the "dark" color could represent the combination of indicating state "1" and sector "B," as well as indicating state "2" and sector "A." As would be appreciated by a person of ordinary skills in the art, the number of indicating states for a particular puzzle is a design choice, and is based on the number of sectors, and the number of colors or images playable by the puzzle.

Color or image charts, also defined as visual indication charts, in the form of lookup tables are provided for each puzzle to define the relationship between sectors, indicating states and specific colors or images used. This relationship could also be defined using an appropriate Boolean function. In such case the sectors, indicating states and colors or images are represented by binary codes or numbers. It should be noted that different embodiments and/or puzzles could employ the same color or image chart. For example, a visual indication chart based on 4 sectors, 4 indicating states, and 4 colors or images could be used for the 2×2, 4×4, or 8×8, two-dimensional embodiments, as well as for the sphere embodiment. Also, when light emitting diodes (LEDs) are used to provide colored indications, it is desirable to employ the "off" state of an LED to provide a "dark" indication. In such a case the color provided at a playing position is the external color reflected from the surface of the indicator at that playing position.

It should be noted that the number of sectors for a particular puzzle could be selected by the player as part of a game setting. For example, in a 4×4 embodiment, the number of selectable sectors could be two with eight indicators per sector, four with four indicators per sector, eight with two indicators per sector, or sixteen with a single indicator per sector. Similarly, the number of colors or images playable by the device could be selected by the player at the beginning of a game. In such a case a plurality of visual indication charts is provided to support all possible puzzle configurations.

One of the main concepts employed by the present invention is to shift or rotate indicating states between various sectors on the playfield. To accomplish such shift or rotation process, each puzzle incorporates a plurality of shift or rotation patterns. The specific pattern or patterns used in a particular puzzle is a design choice. However, it is desirable that the configuration of the shift or rotation pattern is such that an indicating state at any play position on the playfield could be shifted to any other play position on the playfield using one or a plurality of shift or rotation activations. Examples of a shift or rotation patterns on a two-dimensional playfield include shifting the states of the indicators in a specific direction along a column, or a row of an array of indicators, or rotating the states of indicators around a geometric loop on the playfield, either clockwise or counter clockwise. Such a geometric loop could be in the form of a square, rectangle, triangle, circle, figure eight, etc. For a three-dimensional embodiment, the shift or rotation pattern could span more than one plane of the three-dimensional shape, or could be confined to a specific side of the shape such as the side of a cube. Examples of shift or rotation patterns on a cube embodiment include the perimeter square rings that could rotate around one of the three main axes of the cube, and any geometric loop that spans one or a plurality of cube sides. Similarly, for a sphere embodiment, the rotation patterns could be implemented using intersecting rings on the surface of the sphere. The number of rings as well as the number of indicators per ring is a design choice.

As would be appreciated by persons skilled in the art, the design parameters could be manipulated to provide puzzles in various levels of difficulty. For example, if the number of colors is fixed, an increase in the number of sectors results in more difficult puzzles. Also, the configuration of sectors on the playfield affects the difficulty of the puzzle For example in a 4×4 embodiment with 4 sectors, the specific indicators selected for each sector could be manipulated to increase the level of difficulty. The 4 sectors could be configured as columns, rows, or quadrants. The sectors could also be configured using individual playing positions that are disjointed. The level of difficulty for various puzzles is also affected by the rotation or shift patterns employed by the puzzles.

Alternatively, to vary the level of difficulty for a particular game one can manipulate the initial conditions for the game, i.e., the initial display presented to the player. In such a case, the level of difficulty is measured by the number of steps, i.e., the number of shift or rotation activations, required to transform an initial display to a desired game objective.

It is not necessary to provide a switch at each playing position. However, at least one switch is required to activate a rotation or shift pattern in a specific direction. For example, to activate the shift process along a column of indicators, a minimum of two switches is required irrespective of how many indicators are present on the column. One switch is used to rotate the states to the "up" direction, and the second switch is required to rotate the indicating states to the "down" direction. Similarly, to activate the shift process along a row of indicator, two switches are required to shift or rotate the states of the indicators to the "left" or "right" directions.

Further, when a rotation loop is used, i.e., a square, rectangle, circle, figure eight, or the like, two switches are required to shift the states of the indicators on the loop "clockwise," or "counter clockwise." Additional redundant switches could be added to make it easier for the player to manipulate the displays on the playfield. For example, switches could be added on each side of a cube device to control the rotation of a perimeter group of indicators around a corresponding axis. In such a case, four sets of the two required switches for the perimeter group could be located on the four sides of the cube. It is preferable to use momentary switches to activate the rotation patterns. However, as would be obvious to one skilled in the art, bi-stable switches could also be used.

When an LCD display is used, it would be desirable to employ an input control mechanism consisting of a mouse control with two switches. In such case, the mouse control is used to place or point a cursor on a rotation or shift pattern, and to use one of the switches as the UP, RIGHT, or CLOCKWISE control, and to use the second switch as the DOWN, LEFT, or COUNTER CLOCKWISE control.

To heighten the enjoyment of play, a variety of audio and/or visual indications are provided. Such indications could include tones generated in response to switch activations, flashing indicators, and/or the generation of tunes upon the successful completion of a game or an objective of a game. Statistics could also be kept about the performance of players in solving games or puzzles. Such statistics could include the number of steps used by a player to solve the puzzle, and/or the time used to reach a solution. A game could also be timed to challenge a player to solve the game within a predefined period of time.

Each of the preferred embodiment devices is implemented using a microprocessor to control the various aspects of game play. The various parameters and attributes of a puzzle or a game are stored in the read only memory of the device. Alternatively such parameters could be provided in a removable flash memory to enable future additions of puzzles and games. Further, some of the game parameters could be selected by the player at the beginning of a game. The microprocessor is programmed to configure the playfield into the required sectors, monitor the activation of the control switches to implement the corresponding shift or rotation process, rotate the states of affected indicators, and calculate new displays for the indicators. The microprocessor is also programmed to determine if a solution is reached for the game in play, and to generate the appropriate audio/visual effects to reward a player for solving a game or puzzle.

The indicators of the preferred embodiments could be implemented using LED displays or LCD screens. When LED displays are used, different colors could be provided using one discrete LED for each color, or by employing multi-color LEDs that provide two or more colors in addition to being unilluminated. For the purposes of this invention "dark," when used as a design choice to represent one of the visual indications, is considered a color represented by the color reflected from the surface of the indicators. Therefore, a two-color device could be implemented using the "on" and "off" visual indications resulting from a single color LED. It should be noted that the use of LED displays is only for the purpose of describing preferred embodiments, and is not intended to limit the invention herein. As would be understood by a person of ordinary skills in the art, any light emitting means, such as incandescent or fluorescent bulbs, could be used to provide visual indications.

When LCD screens are used, such screens could be of the monochromic type or the color type. When monochromic screens are used, the plurality of images could be provided by different images. When colored screens are used, the plurality of images could be provided by different images or symbols, or by the same image or symbol depicted in different colors. For the purposes of this invention a blank display could be used to represent an indicating state. Therefore, a two-image puzzle could be implemented using a single image and a blank display.

The puzzle device could also be provided as a computer game that is played on a desktop, or laptop computer, or could be designed as a game provided on a CD, DVD or special cartridge for electronic games such as Game Cube, PS2, X-Box, Game Boy, or the like. The Puzzle device could also be provided on a consumer electronic device such as a palm pilot, a Blackberry, a cell phone, or the like.

BRIEF DESCRIPTION OF THE DRAWINGS

These and other more detailed and specific objectives will be disclosed in the course of the following description taken in conjunction with the accompanying drawings wherein:

FIG. 14 is a visual indication chart in the form of a lookup table that describes the relationship between eight visual indications (colors or images), eight sectors, and eight indicating states.

FIG. 19 is an example of a first alternate sector configuration for a 4×4 embodiment, using 4 sectors: A, B, C & D.

FIG. 21 is an example of a sector configuration for a 5×5 embodiment, using 5 sectors: A, B, C, D & E.

FIG. 23 is an example of a sector configuration for a 7×7 embodiment, using 7 sectors: A, B, C, D, E, F & G.

FIG. 24 is an example of a sector configuration for an 8×8 embodiment, using 8 sectors: A, B, C, D, E, F, G & H.

FIG. 30 is a visual indication chart in the form of a lookup table that describes the relationship between two visual indications (colors or images), six sectors, and six indicating states.

DESCRIPTION OF PREFERRED EMBODIMENTS

Figure 1:
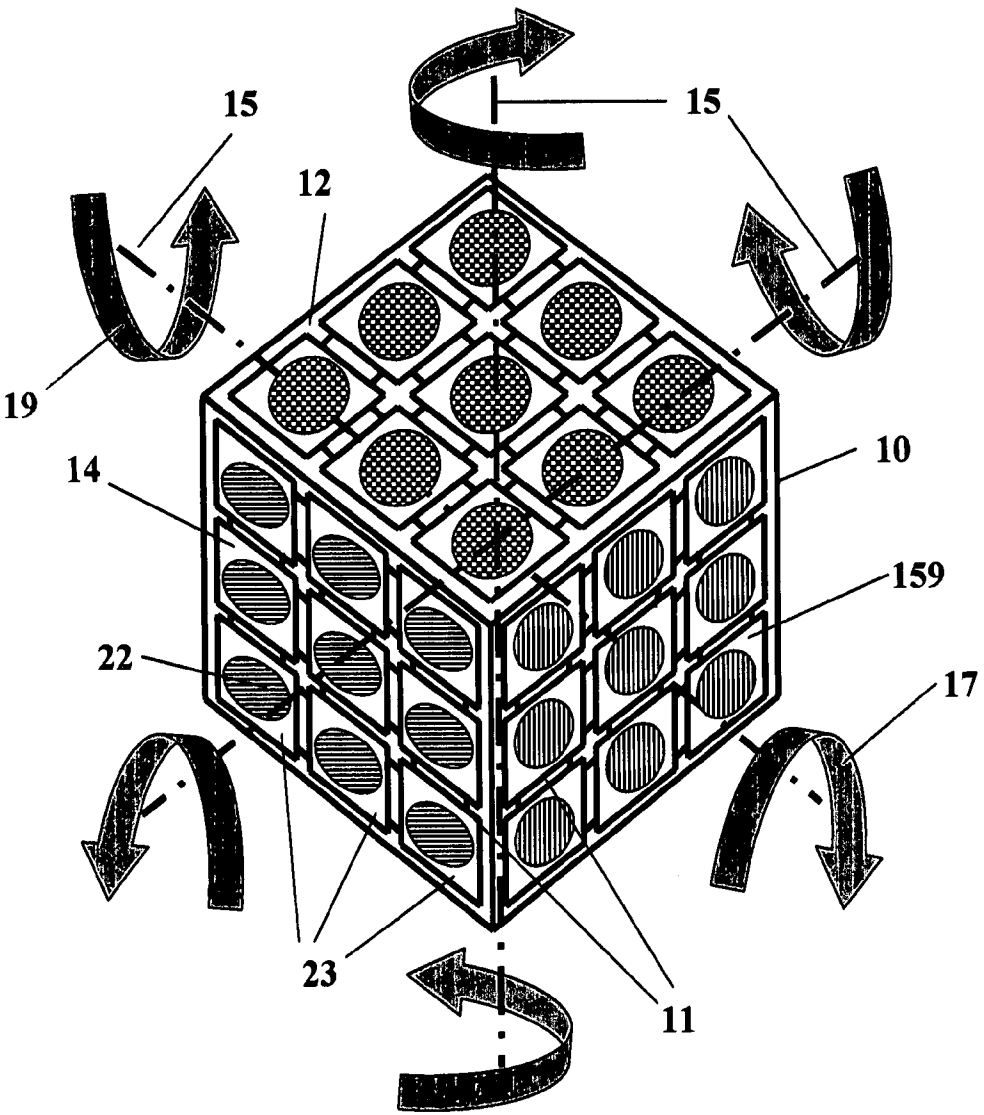
FIG. 1 is a perspective view of a preferred embodiment of a puzzle device according to the invention, shaped as a cube, and employing LED displays.

Referring now to the drawings where the illustrations are for the purpose of describing a number of preferred embodiments of the invention, and are not intended to limit the invention hereto. FIG. 1 is a perspective view of an electronic hand-held puzzle device 10 shaped as a cube, and comprised of a housing 12 having six sides, each of which carrying an array of indicators 14, and each indicator has a plurality of indicating states, and is capable of providing a visual representation of any of said plurality of states. The number of indicators on each side of the cube is a design choice. The indicators could be implemented using multi-color LEDs, monochromic LCD screens, or colored LCD screens. Plasma screens, or other type of colored screens known in the art could also be used. However, for the purpose of describing this preferred embodiment, the device illustrated in FIG. 1, employs nine LED indicators 22 for each side of the cube for a total of 54 indicators.

The maximum number of colors provided by this cube device at each playing position is a design choice. However, for the preferred embodiment illustrated in FIG. 1, the number of colors provided is six. The six colors could be provided by six illuminated colored indications, or in the alternative by five illuminated colors and one unilluminated color. The advantages of employing an unilluminated color are to conserve electrical energy, and to reduce the number of LED elements required. When using an unilluminated color, the specific color presented to the player is the color reflected from the surface of an indicator. The specific colors used for the cube device are red, green, yellow, blue, orange, and white. The white color is unilluminated, and is produced when the LED at a playing position is dark. As would be obvious to one skilled in the art, the specific colors selected have no impact whatsoever on the functionality of the device. A toy designer may elect to use any colors of his or her choosing.

To provide five illuminated colors, it is desirable to employ a single RGB type LED at each playing position. An RGB type LED is capable of providing multi-colored indications, and has four leads. Three of the four leads are connected to red, green and blue LED elements. The fourth lead is connected to a common battery bus. To provide the primary colors of red, green, or blue, only the LED lead corresponding to the desired color need to be energized. The remaining two illuminated colors are produced by mixing the primary colors in a predetermined manner, which is accomplished by energizing a plurality of the three main LED leads using various duly cycles.

Figure 12:
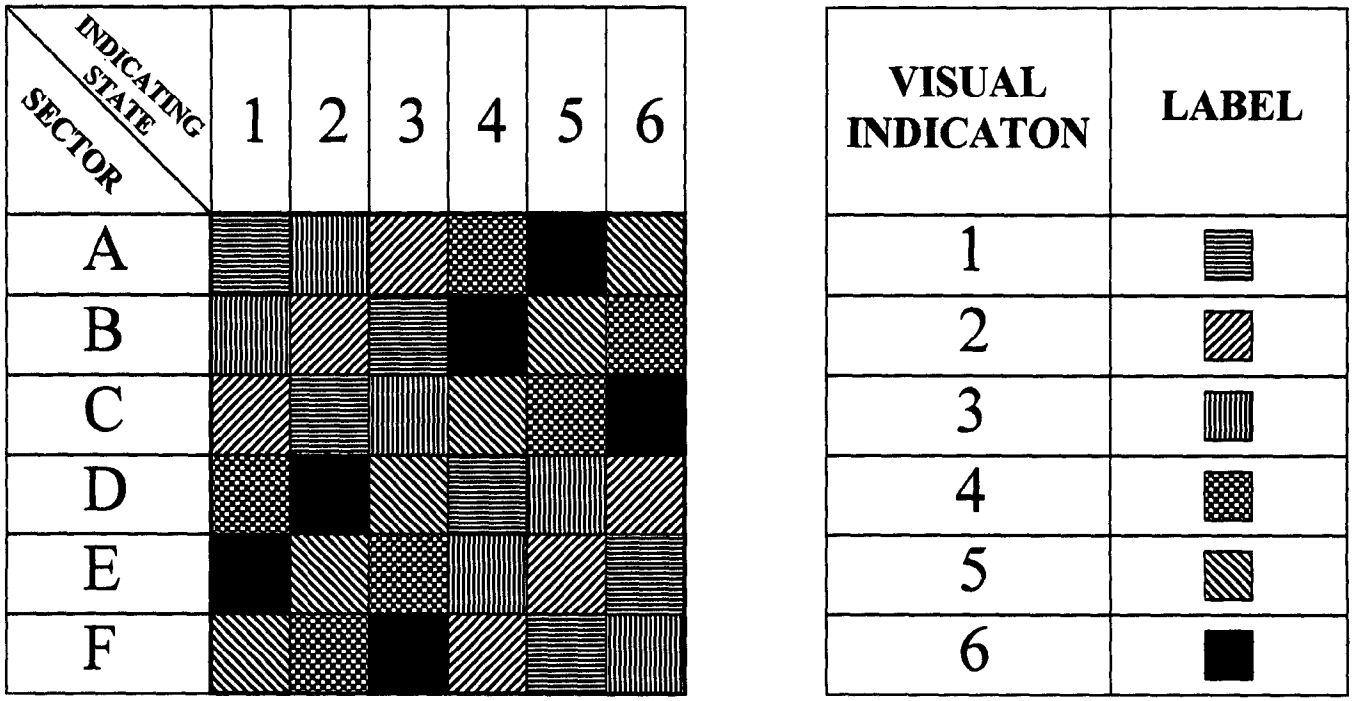
FIG. 12 is a visual indication chart in the form of a lookup table that describes the relationship between six visual indications (colors or images), six sectors, and six indicating states.
Figure 13:
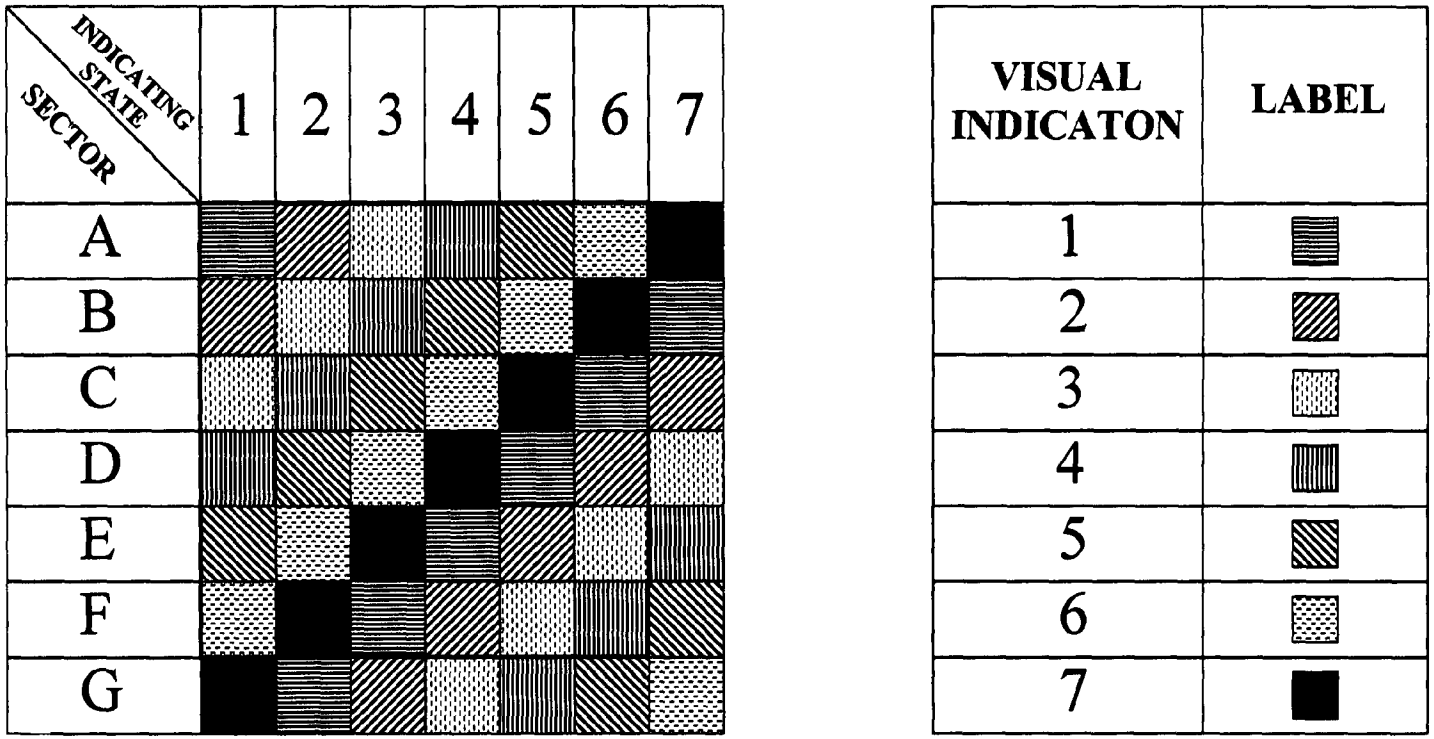
FIG. 13 is a visual indication chart in the form of a lookup table that describes the relationship between seven visual indications (colors or images), seven sectors, and seven indicating states.

The playfield consisting of the 56 indicators is divided into six sectors configured as the six sides of the cube device. Each sector includes 9 indicators. The cube device also employs 6 indicating states per indicator. As an indicating state is shifted or rotated from one sector to another sector, it provides a different color in accordance with the visual indication chart shown in FIG. 12. It should be noted that, for this preferred embodiment, when an indicating state is shifted from one indicator to another indicator within the same sector, it produces the same color. Further, even though there are six indicating states per indicator, it would be a simple task to provide a puzzle that operates with only two colors using such six indicating states. This is accomplished, for example, by assigning half of the thirty-six (36) sector/indicating states combinations to one color, and the remaining half to a second color as shown in FIG. 30. There are many other indicating chart configurations to provide two colors, or in more general terms two visual indications, using six indicating states. Obviously, a two-color operation could also be provided using two indicating states.

When a two-color operation is the only operation required by the cube device, then all that is needed at each playing position is a single element LED that provides two indications, namely an "ON" indication, and an "OFF" indication. Obviously, the two indications could also be provided by any two illuminated colors. It should be noted that a game designer could employ different shades of the same color, different levels of brightness, or flashing indications to represent the indicating states. What is important is that the six indicating states are presented to the player as six visual indications that are distinguishable from each other. For example, a single element LED could provide three visual indications defined as ON, OFF, and FLASHING.

The cube device shown in FIG. 1 employs rotation patterns each of which consists of a perimeter strip of indicators 11 with indicating states that rotate around one of the three main axes of the cube 15. There are a total of nine perimeter strips of indicators. Each of such strips has four (4) sections that span the four sides of the cube, and contains twelve (12) indicators. The indicating states associated with indicators on a particular strip can rotate in a clockwise 17 or in a counter clockwise direction 19. For this preferred embodiment, when a rotation function is executed for a particular perimeter strip, the indicating states associated with the 12 indicators on the strip are shifted by one position in the direction of rotation. As would be appreciated by one skilled in the art, a game designer may elect to implement a rotation function that is based on shifting the indicators by a plurality of positions in the direction of rotation.

To activate the rotation function for a particular strip, the player is provided with four switch mechanisms, each of which is located on one of the four sections or sides of the strip. It should be noted that, even though only one switch mechanism is required for each strip, an additional three switch mechanisms are provided for ease of manipulation of the device. In the preferred embodiment, each switch mechanism consists of two momentary switches 21 located at each end of the strip section that spans one side of the cube. It is preferable that the switch activation action be a sliding action in the direction of rotation. It is also preferable to enable the player to activate the switches from any of the three playing positions 23 located on any of the four sections of the strip.

Figure 31:
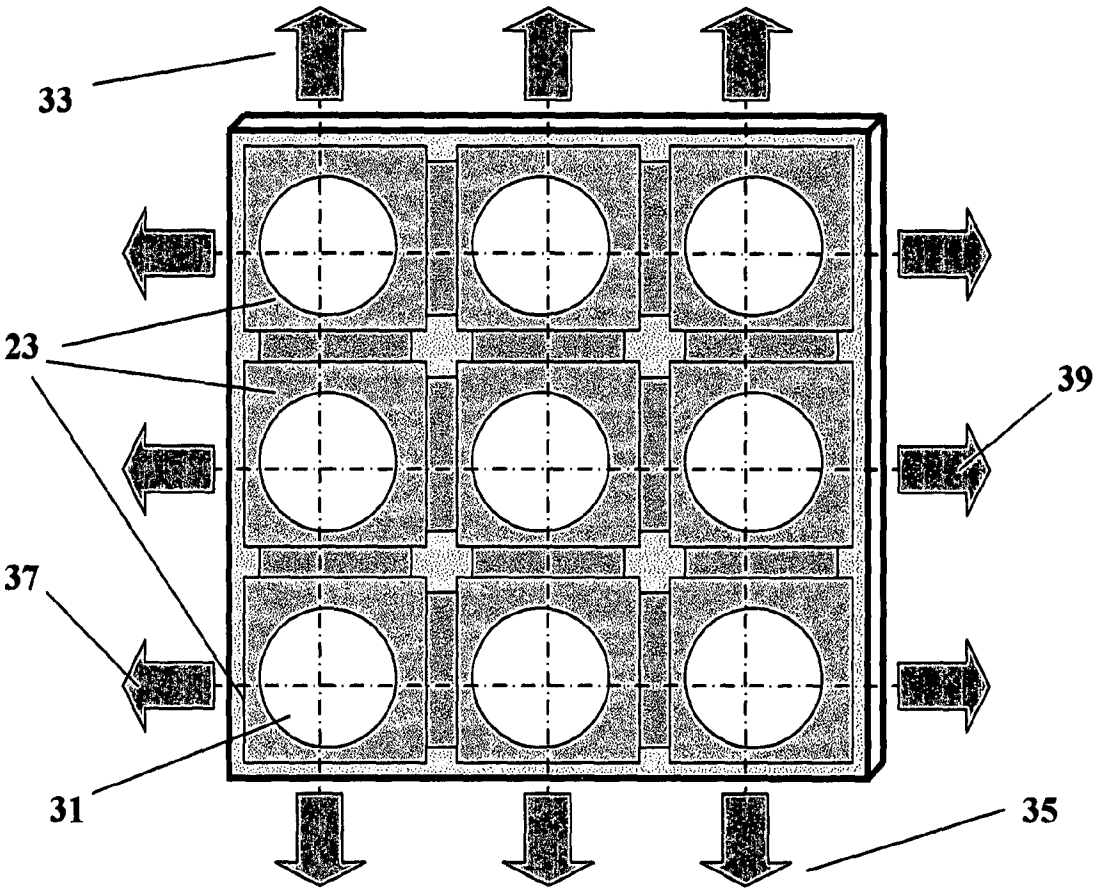
FIG. 31 is a switch configuration for one side of the cube device shown in FIG. 1. This configuration indicates the various directions of switch sliding control actions.

To accomplish these two objectives, a novel switch activation mechanism is shown in FIG. 31. This activation mechanism consists of nine interlocked square pieces corresponding to the nine playing positions at one side of the cube. Six of such mechanisms are provided for the cube device. Each of the square pieces includes a white diffused lens 31 to allow an illuminated color to emit through the lens, and to produce a white color when the LED at a playing position is unilluminated. The interlocking structure allows a piece on a strip section to push or pull adjacent pieces depending on the direction of the sliding action. Since there are two intersecting rotation strips at each playing position, which are perpendicular to each other, each piece can slide in four different directions. Looking at any side of the cube, each piece could slide up 33, down 35, left 37, and right 39. Further, the interlocking structure allows the three pieces on a strip section to slide relative to an adjacent stationary strip sections. The sliding action is such that after the player releases the activation mechanism, a spring action associated with one of the two momentary switches returns the section to its neutral position, which is aligned with the remaining strip sections on the cube side.

It should be noted that the above description for the switch activation mechanism is set forth for the purpose of describing a preferred embodiment, and is not intended to limit the invention herein. As would be appreciated by persons of ordinary skills in the art, alternate switch configurations could be used to activate the rotation patterns. For example, two momentary push buttons shaped as arrowheads could be provided for each strip sector. Each of these push buttons could be located at the edge of the sector, and pointing to the direction of rotation. Alternatively, a momentary switch could be provided at each playing position. When such switch configuration is used, a player must activate two switches on a rotation strip in a sequence that corresponds to the desired direction of rotation.

The device shown in FIG. 1, also, includes an on/off switch 16 (not shown), which controls the operational state of the device, and the connection of the internal battery supply 82 to the electronic circuitry. The on/off control function could also be provided by simultaneously activating any two strip-sections in the same direction. In addition, the device includes a select switch 18 (not shown) to select a particular puzzle, and a specific game. The select switch is pressed a first time to select a puzzle, and a second time to select a game. The select control function could also be provided by simultaneously activating any two strip-sections in opposite directions. Further, the device includes audio circuits, or an audio driver 58, and a speaker 76 to generate audio effects during game play.

The cube device shown in FIG. 1 provides a plurality of puzzles in various levels of difficulty. One parameter that affects the difficulty level of a puzzle is the configuration of the sectors in the playfield, i.e., the mapping of the fifty-four (54) indicators to the six (6) sectors. For example, a sector of nine (9) indicators could consist of all nine indicators on a single side of the cube, or in the alternative a sector could map three strips on three different sides of the cube, wherein each of such strips includes three indicators. A sector could also consist of nine disjointed indicators located on all six sides of the cube.

Further, the cube device provides a plurality of games for each puzzle. A game is defined by an initial display pattern presented to the player, and a game objective. One game objective provided by the cube device is to reach a game state, wherein all fifty-four (54) indicators display the same color. A second game objective is to reach a game state, wherein all nine indicators on each side of the cube display the same color, and wherein each side of the cube displays a different color. As would be appreciated by one skilled in the art, other game objectives could be provided for the cube device.

The initial display pattern for a particular game is established by starting with a display that corresponds to the game objective, and by performing one or a plurality of rotation actions in order to scramble the display. This initial display is produced by an initial assignment of indicating states to the indicators on the playfield. The initial conditions for a game could be stored as program data in ROM 62, or in a flash memory 94, in the form of initial indicating states for all fifty-four indicators, or in the alternative such initial conditions could be stored in memory as data describing the rotation actions required to produce the initial display from a game objective. One measure of the level of difficulty for a particular game is the minimum number of steps required to transform an initial display pattern to a game objective. The player employs the select switch 18 to select a particular puzzle, and a specific game from a plurality of puzzles and games stored in the device.

Figure 34:
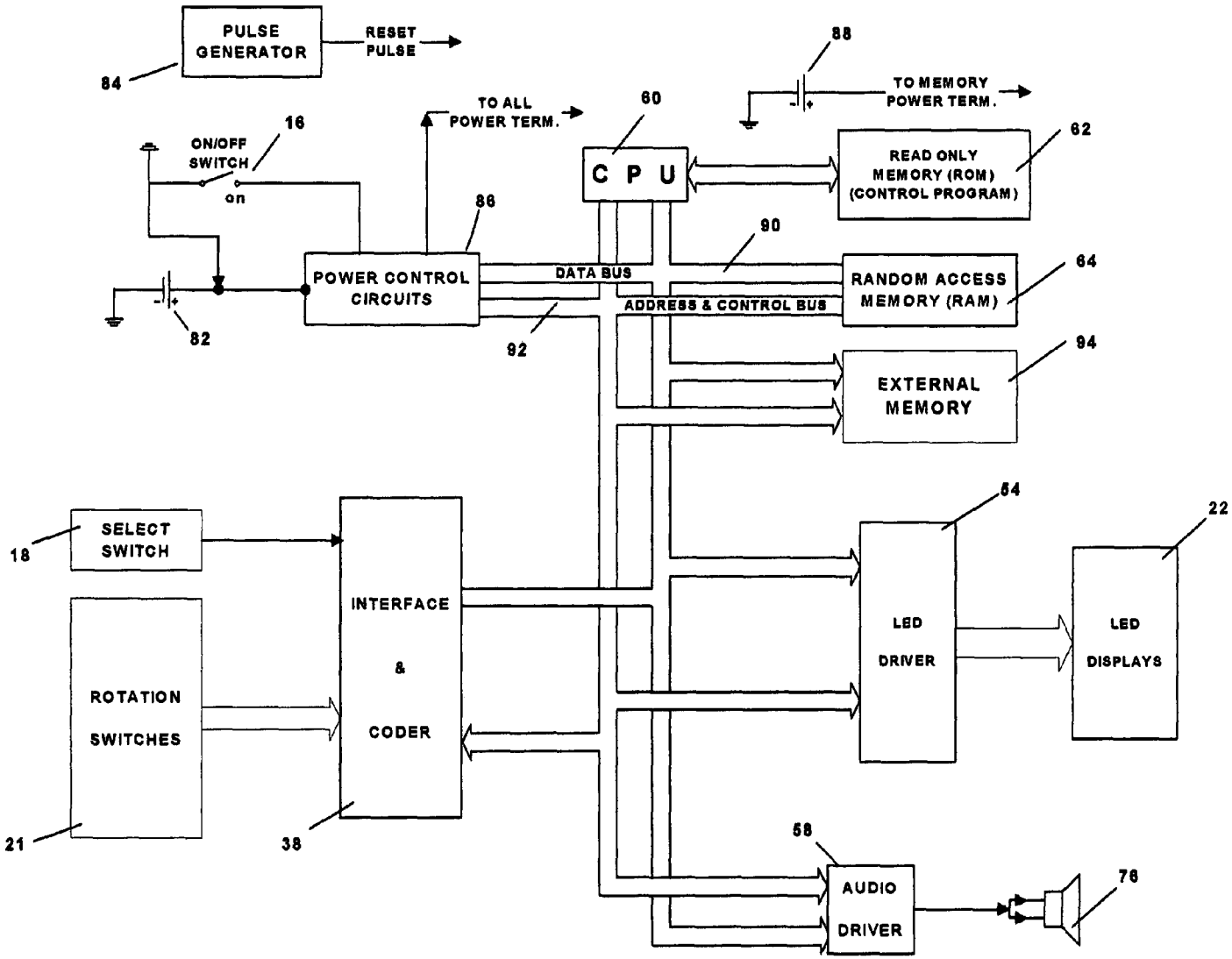
FIG. 34 is a block diagram of a microprocessor circuit utilized by the present invention for an embodiment that employs LED indicators.

A block diagram of the control circuitry for this game device 10 is illustrated in FIG. 34. This control circuitry includes a central processing unit 60 having a control program residing in a read only memory (ROM) 62, an external FLASH memory 94 that contain additional puzzles and/or games, a random access memory (RAM) 64, an interface and coding device 38, an LED driver 54, and audio interface and control circuits (audio driver) 58. The interface and coding device 38 is used as input interface between the rotation switches 21 & the select switch 18, and the central processing unit 60. In contrast, the LED driver 54 is used as an output interface between the central processing unit 60 and the LED displays 22. Similarly, the audio driver 58 is used as output interface between the central processing unit 60 and the loudspeaker 76. A common address and control bus 92, and a separate common data bus 90 are used to interconnect the central process unit 60 with the interface and coding device 38, the LED driver 54, the audio driver 58, the read only memory (ROM) 62, the random access memory (RAM) 64, and the external memory device 94. An ON/OFF switch 16 is used to connect a main battery 82 to the power control circuits 86. A second optional battery 88 could be used to supply electrical energy to memory devices.

It should be noted that the above description of the control circuits of the cube device is provided as an example for illustration purposes only, and is not intended to limit the present invention. As would be appreciated by those skilled in the art, a game designer would most likely select a micro-controller with built-in audio driver to control the game device. Such micro-controller would include I/O ports that can be configured as input or output ports, and could be used to connect the control switches and other control push buttons directly to the micro-controller without the need for any interface and coding devices or memory decoder drivers. Such micro-controllers are well known to those skilled in the art.

The cube device could also be implemented using either monochromic or color screens with back lighting. A total of six screens are required to provide the playfield on the surface of the cube. Each of such screens represents one sector on the playfield. As an alternate to the LED embodiment, each screen is divided into sixteen (16) playing positions, and each playing position could indicate up to six different images. The differences between the images could be in shape and/or color. For example, the images could be simply a single geometric shape produced in six different colors. Alternatively, the images could be six different geometric shapes produced in the same color. Such configuration is suitable when monochromic screens are used. Another example is to employ different images with various colors, such as fruit symbols in their natural colors, to provide the six different images. What is important for the objectives of this invention is that the images be distinguishable from each other.

Figure 37:
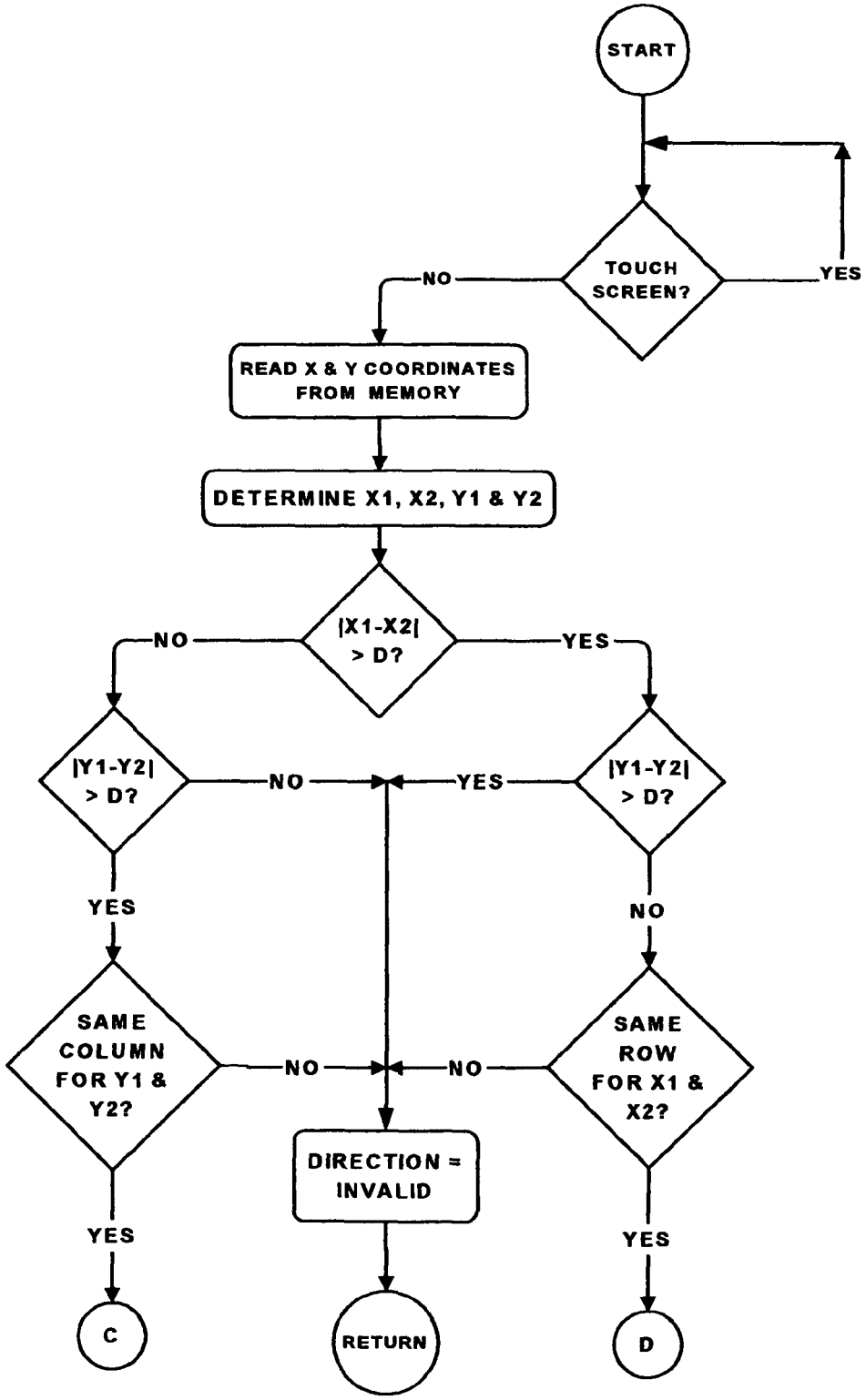
FIGS. 37 & 38 is an example flow diagram illustrating the logical steps to implement a touch screen sliding control function according to the invention.
Figure 38:
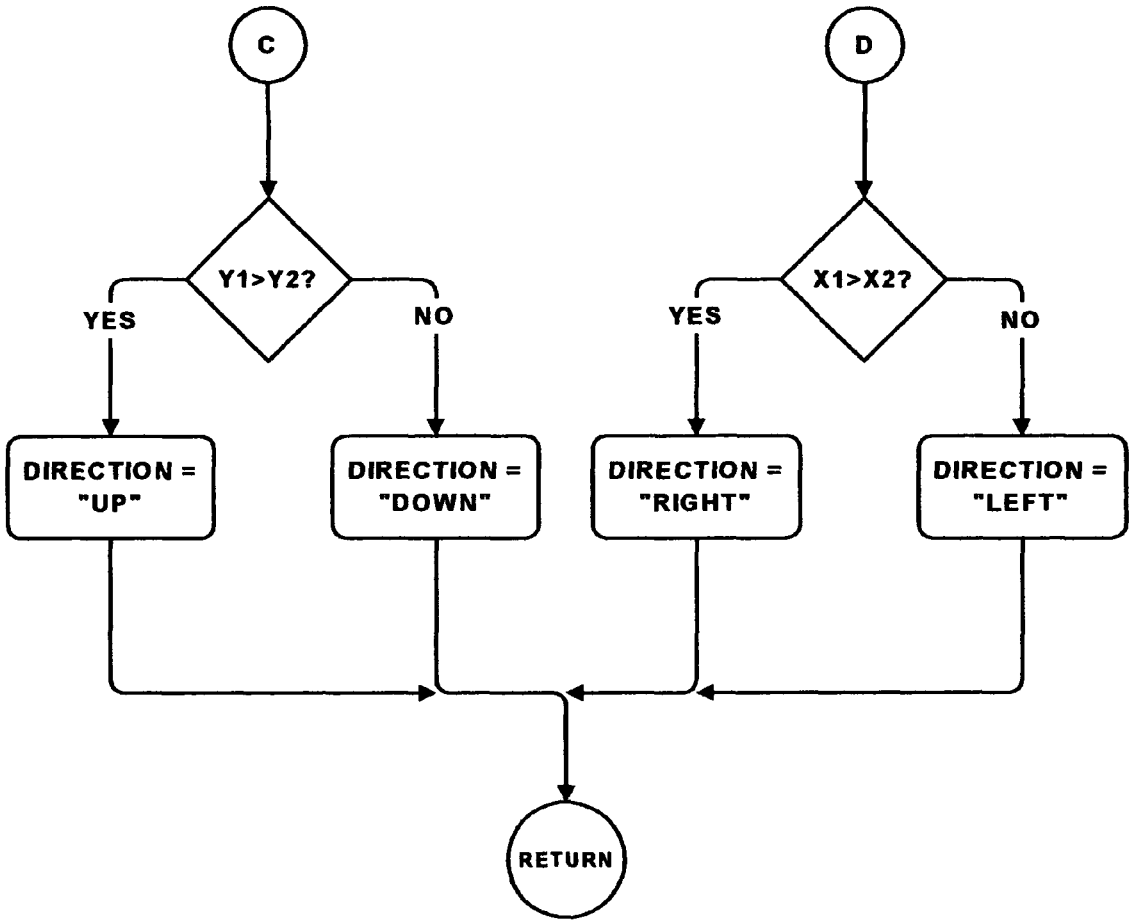

This alternate cube device operates with six indicating states that rotate between the six sectors of the cube, i.e., the six screens. The rotation patterns are similar to those employed by the LED cube device. To activate the rotation function, the device employs touch screen controls with an algorithm that detects a sliding touch control action, and determines the direction of such control action by the player. To implement this touch screen algorithm, each screen employs an x-y coordinate configuration to identify the specific point on the screen at which the player is touching the screen. The player is instructed to slide his or her finger on the surface of the cube, along a selected strip, in the desired direction of rotation. The player is further instructed to maintain the sliding action for a minimum space equal to the distance between two adjacent playing positions. Such instruction would ensure that the player would not inadvertently activate a rotation function by simply touching the cube device. An example flow diagram for the touch screen control algorithm is shown in FIGS. 37 & 38. Upon the detection of such sliding action, the microprocessor captures the coordinates of all points on the playfield touched by the player. The control program then calculates the values for X1, X2, Y1 & Y2, wherein X1=initial x-coordinate; X2=last x-coordinate; Y1=initial y-coordinate; and Y2=last y-coordinate. The control program, also, check if the distance of the sliding action exceeds a threshold D, where D represents the spacing between two adjacent playing positions. The control program then determines the direction of rotation, and activates the selected rotation pattern in the rotation direction.

An alternate switch control mechanism for the LCD cube device includes a plurality of momentary switches that are activated by the player by pressing on a special icon located on the field of play. Each rotation strip requires a minimum of two momentary switch controls, one for each direction of rotation.

Figure 33:
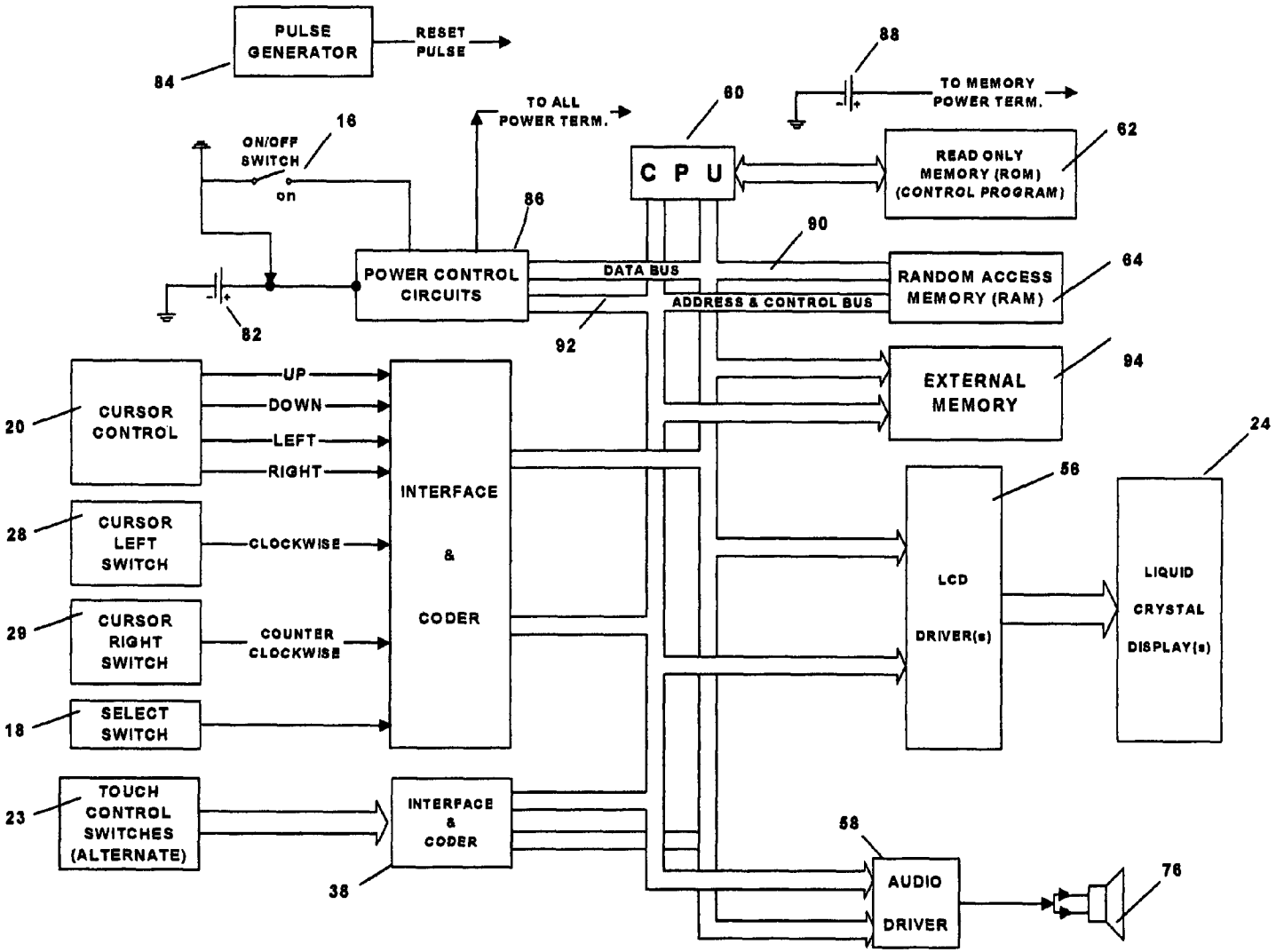
FIG. 33 is a block diagram of a microprocessor circuit utilized by the present invention for an embodiment that employs LCD indicators.

The control circuitry for an LCD cube device is shown in FIG. 33. This block diagram is very similar to the block diagram shown in FIG. 34, except that LCD drivers 56 are required in lieu of the LED drivers to interface the microprocessor 60 with the LCD screens 24. Also, this block diagram shows two alternate types of switch control mechanisms to activate the rotation patterns. The first type of rotation switch 23 employs touch screen technology, and is used in an alternate embodiment of the cube device that uses LCD screens. The second type of rotation switch uses a curser control structure 20 with two associated switches 28 & 29 for clockwise, and counter clockwise rotations. This curser based rotation switch assembly is used for the device indicated in FIG. 5. Further, similar to the LED version, the LCD cube device provides a plurality of puzzles and games.

Figure 2:
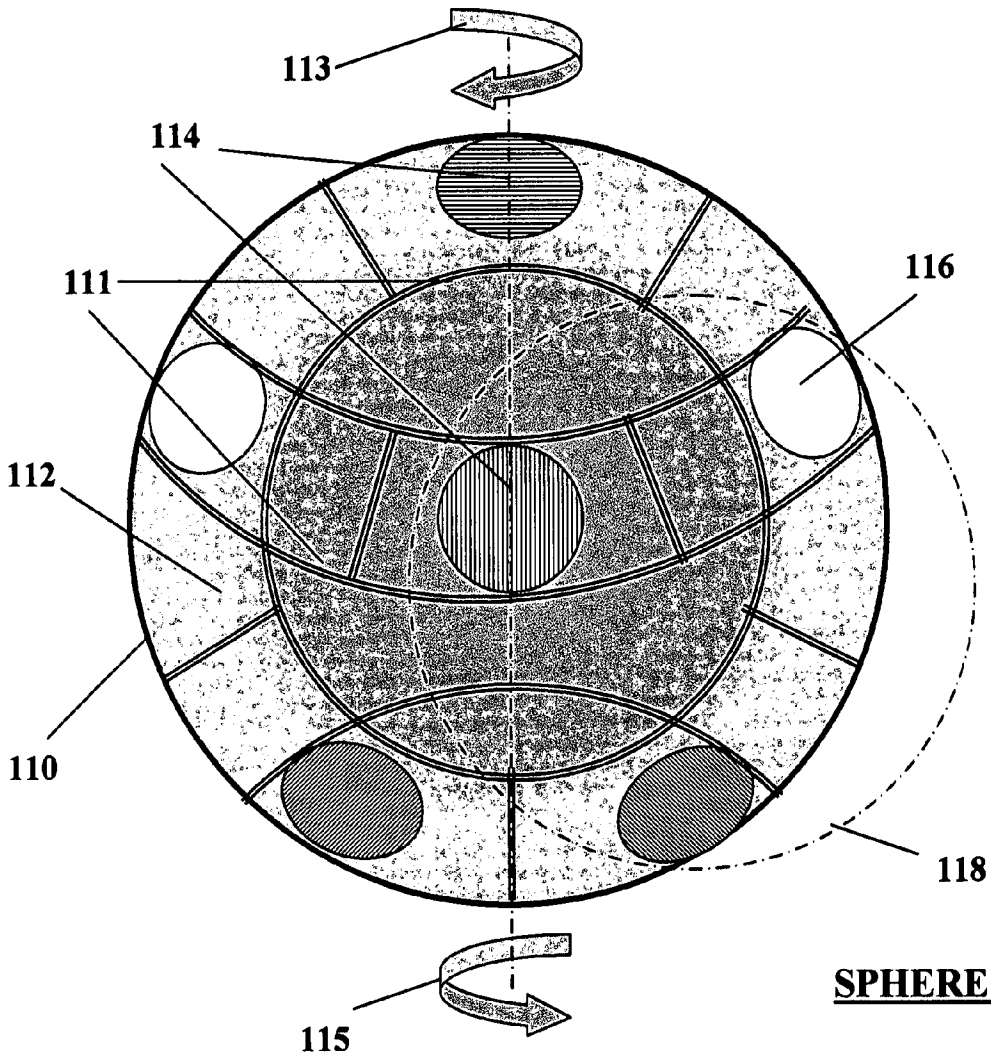
FIG. 2 is a perspective view of a preferred embodiment of a puzzle device according to the invention, shaped as a sphere, and employing LED displays.

FIG. 2 is a perspective view of an electronic hand-held puzzle device 110 shaped as a sphere, and comprised of a housing 112 having a plurality of indicators 114, and each indicator has a plurality of indicating states, and is capable of providing a visual representation of any of said plurality of states. The number of indicators on the surface of the sphere is a design choice. However, for the embodiment illustrated in FIG. 2, there are twelve (12) indicators configured on four sectors of the sphere. The indicators are implemented using multi-color LEDs, each of which is capable of indicating a maximum of four (4) different states. The control circuits for this sphere device employ the block diagram shown in FIG. 34.

The maximum number of colors provided by the sphere device is a design choice. However, for the embodiment illustrated in FIG. 2, the number of colors provided is four. The four colors could be provided by four illuminated colored indications, or in the alternative by three illuminated colors and one unilluminated color. Similar to the LED cube device, the advantages of employing an unilluminated color are to conserve electrical energy, and to reduce the number of LED elements required. When using an unilluminated color, the specific color presented to the player is the color reflected from the surface of an indicator. The specific colors used for the sphere device are red, green, yellow, and white. The white color is unilluminated, and is produced when the LED at a playing position is dark 116. As would be obvious to one skilled in the art, the specific colors selected have no impact whatsoever on the functionality of the sphere device.

To provide three illuminated colors, it is desirable to employ a single bi-color LED at each playing position. A bi-color LED is capable of providing at least three different lighted colored indications, and has three leads. Two of the three leads are connected to red & green, or red & yellow LED elements. The third lead is connected to a common battery bus. To provide the primary colors of red and green, for example, only the lead corresponding to the desired color need to be energized. The third color, yellow, is produced by mixing the primary colors of red and green. This is accomplished by energizing both the red and green leads of the LED in a predefined duty cycle. It should be noted that other types of LEDs could be used to provide multi-colored indications. For example, a plurality of LEDs could be used at each playing position such that each individual LED provides a separate illuminated color. Also, it is possible to use a multi-color LED having only two leads. Such an LED produces different colors depending on the polarity of electrical energy connected to the LED. Additional colors are produced by continuously reversing the polarity of electrical energy connected to the LED using different duty cycles.

Also, multi-colored visual indications could be provided by means other than the use of lighted indications. For example, the different colors could be provided by mechanical means, chemical means, or any other manner known in the art.

Figure 8:
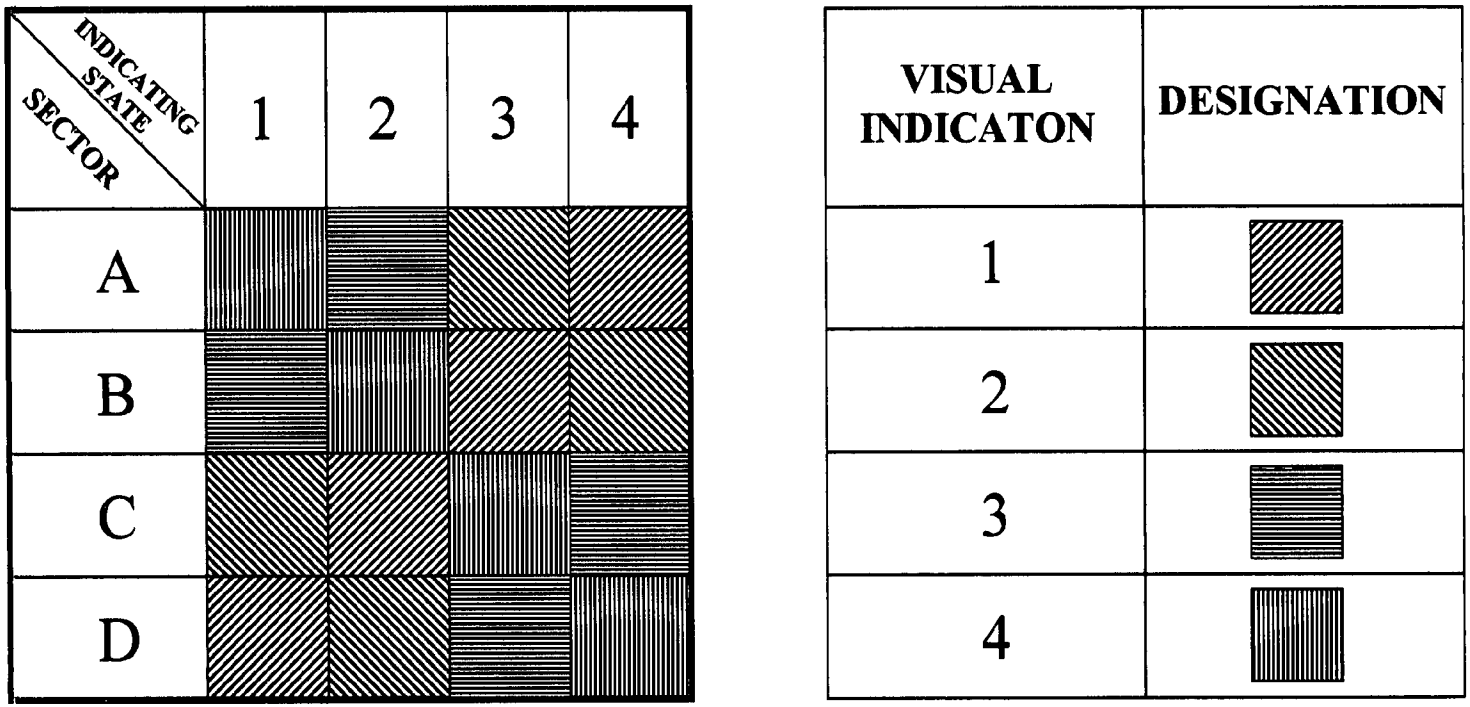
FIG. 8 is a visual indication chart in the form of a lookup table that describes the relationship between four visual indications (colors or images), four sectors, and four indicating states.
Figure 9:
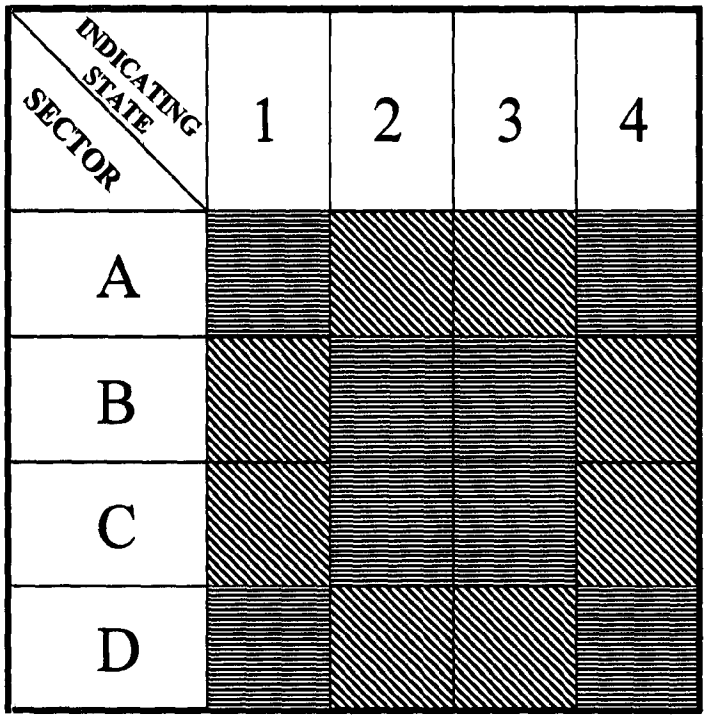
FIG. 9 is a visual indication chart in the form of a lookup table that describes the relationship between two visual indications (colors or images), four sectors, and four indicating states.
Figure 10:
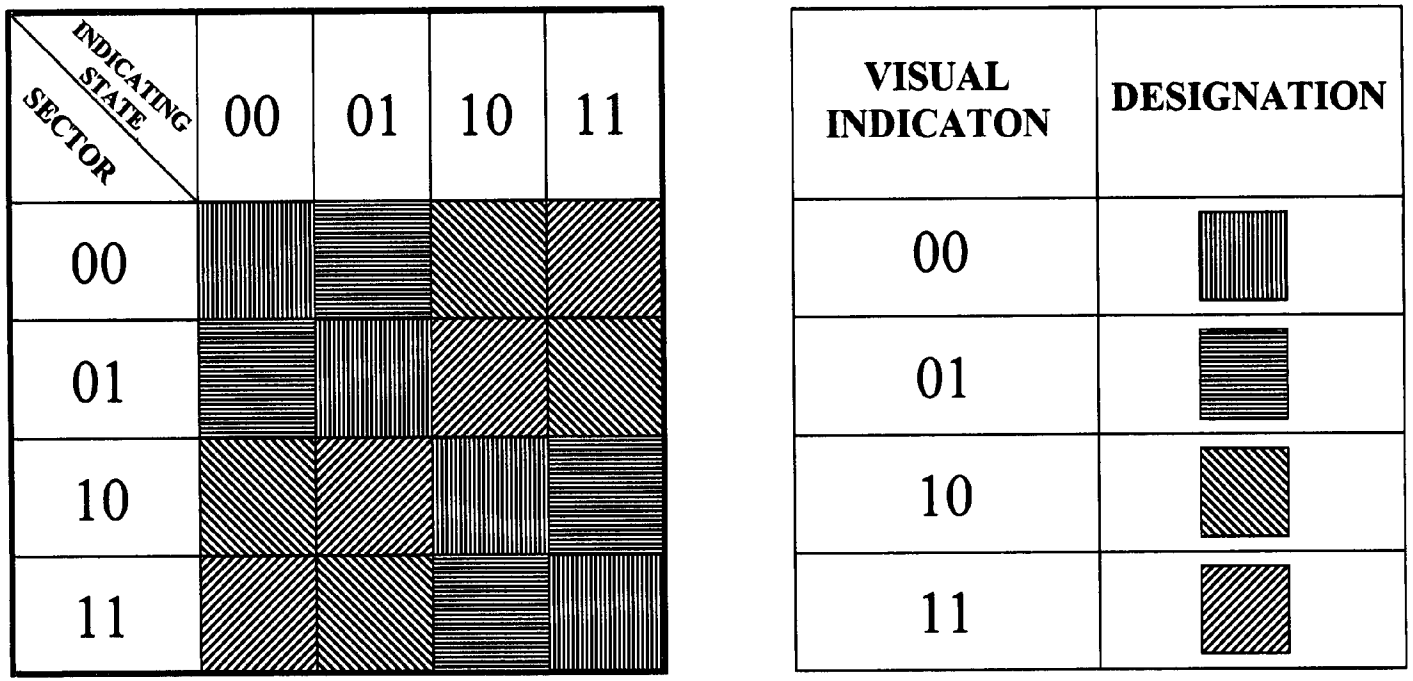
FIG. 10 is a tabulation showing the binary representation of the visual indication chart of FIG. 8, i.e., the relationship between four visual indications (colors or images), four sectors, and four indicating states. The tabulation, also, represents the truth table for the Exclusive Or Boolean function.
Figure 11:
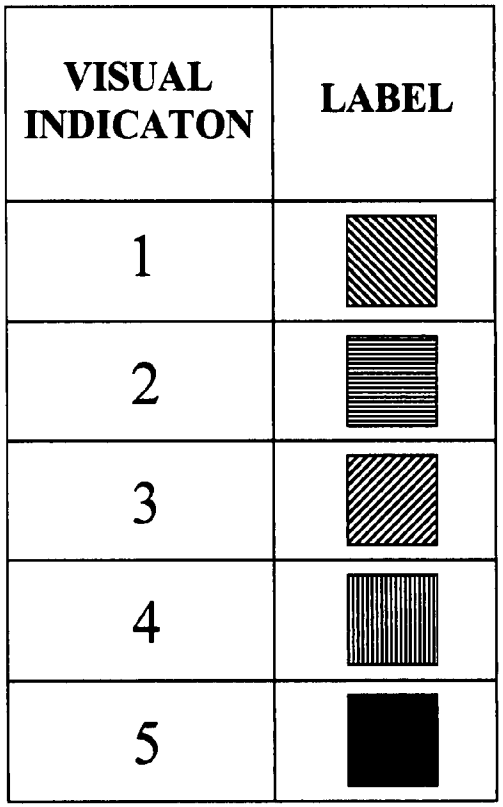
FIG. 11 is a visual indication chart in the form of a lookup table that describes the relationship between five visual indications (colors or images), five sectors, and five indicating states.
Figure 11:
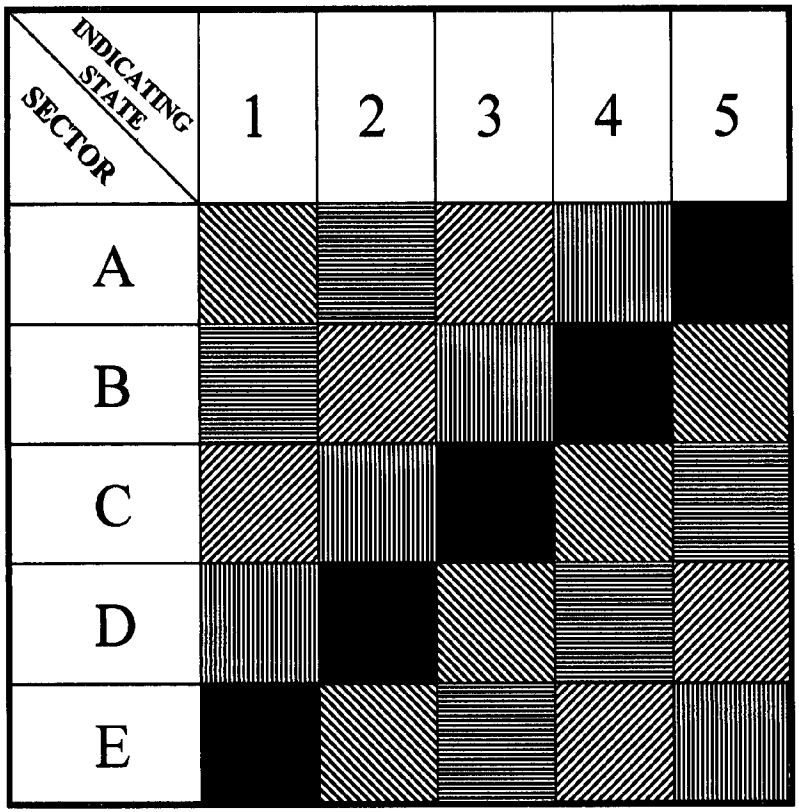

The playfield of the sphere device is divided into four (4) sectors 118, each of which includes three (3) indicators. The sphere device also employs four (4) indicating states per indicator. As an indicating state is shifted or rotated from one sector to another sector, it provides a different color in accordance with the visual indication chart shown in FIG. 8. It should be noted that, when an indicating state is shifted from one indicator to another indicator within the same sector, it provides the same color. Further, even though there are four indicating states per indicator, it would be a simple task to provide a puzzle that operates with only two colors using such four indicating states. Similar to the cube device, such two-color operation is accomplished by assigning half of the sixteen (16) sector/indicating states combinations to one color, and the remaining half to a second color as shown in FIG. 9. Obviously, a two-color operation could also be provided using only two indicating states.

The sphere device shown in FIG. 2 employs rotation patterns each of which consists of a ring of five indicators 111. The states of the five indicators in a ring could rotate around an axis perpendicular to the plane of the ring, and passing through the origin of the sphere 114. There are a total of four rings of indicators on the sphere that intersect with each other as shown in FIG. 2. The indicating states associated with indicators on a particular ring can rotate in a clockwise 113, or in a counter-clockwise direction 115. When a rotation function is executed for a particular ring, the indicating states associated with the 5 indicators on the ring are shifted by one position in the direction of rotation.

To activate the rotation function for a particular ring, the player is provided with a switch mechanism similar to that used for the cube device, i.e., having a sliding action in each direction of rotation 113 or 115. The switch mechanism employs interconnected pieces that form a ring, and includes two momentary switches, each of which corresponds to a rotation direction. The ring could be activated by placing two fingers on opposite sides on the ring, and by a twisting-sliding action to move the ring in the direction of rotation. This mechanical configuration enables a player to activate the switch mechanism from any position on the ring, and independent of the orientation of the sphere device.

Figure 3:
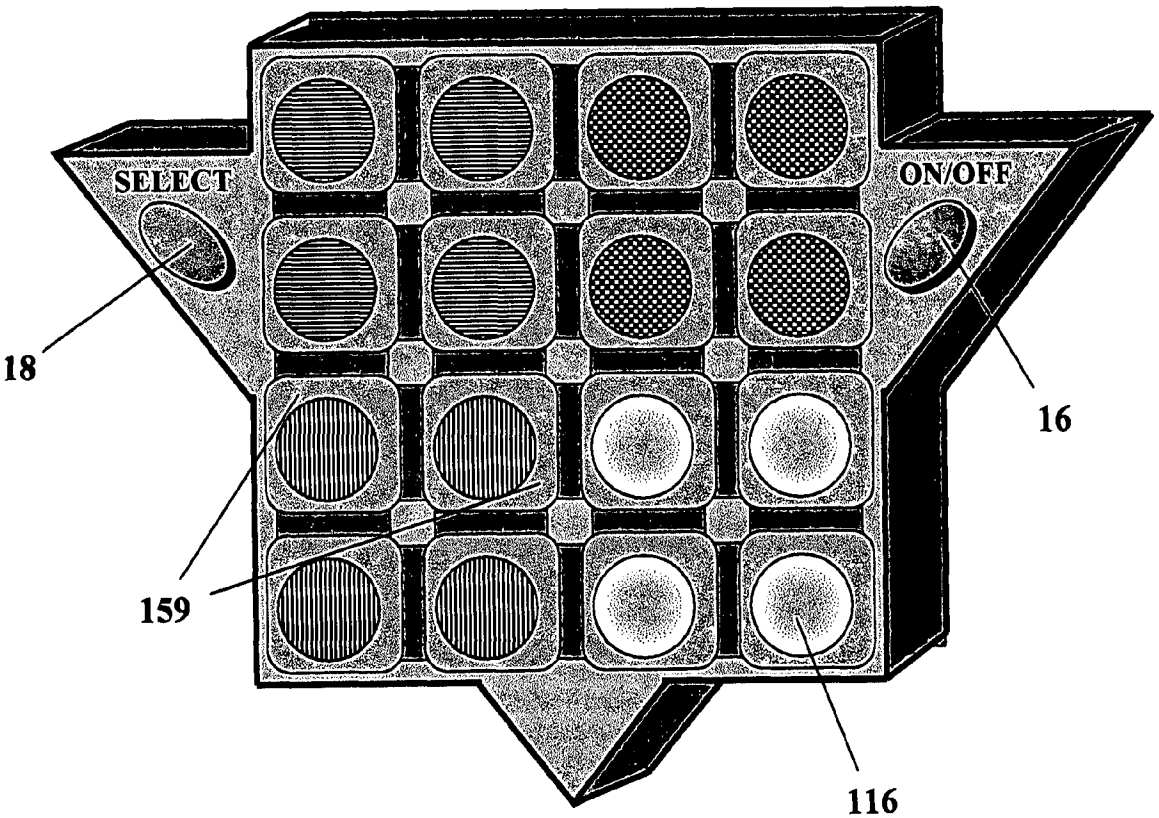
FIG. 3 is a perspective view of a preferred embodiment of a puzzle device according to the invention, and employing a 4×4 array of indicators.
Figure 4:
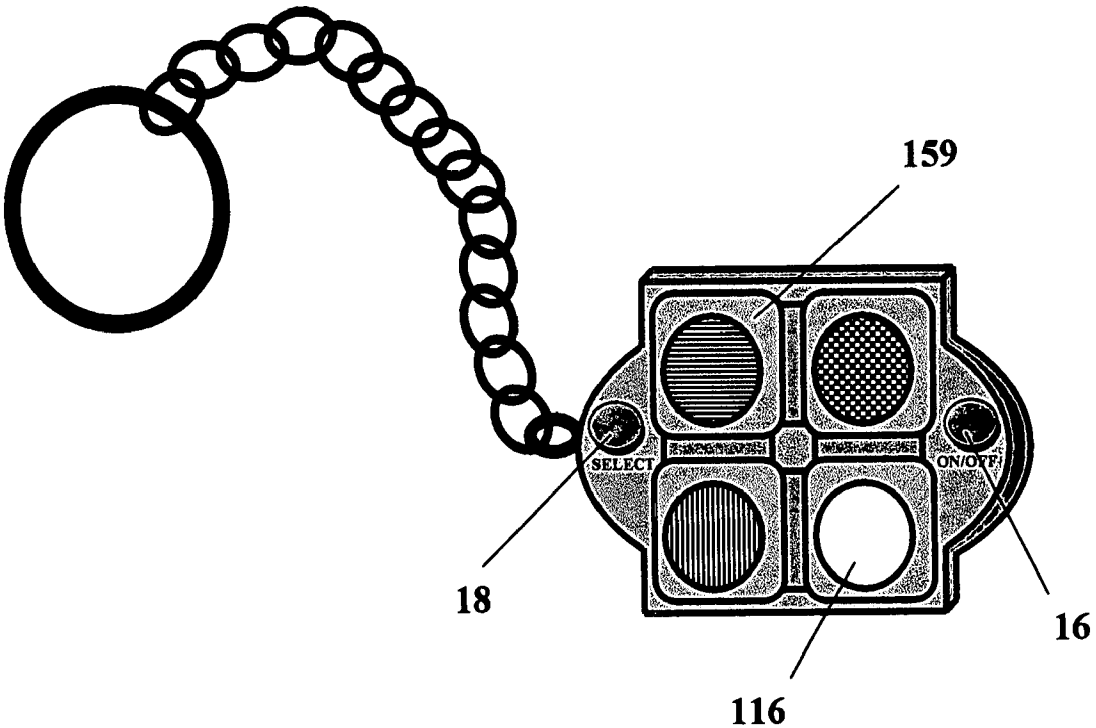
FIG. 4 is a perspective view of a preferred embodiment of a puzzle device according to the invention, and shaped as a key chain using a 2×2 array of indicators.
Figure 5:
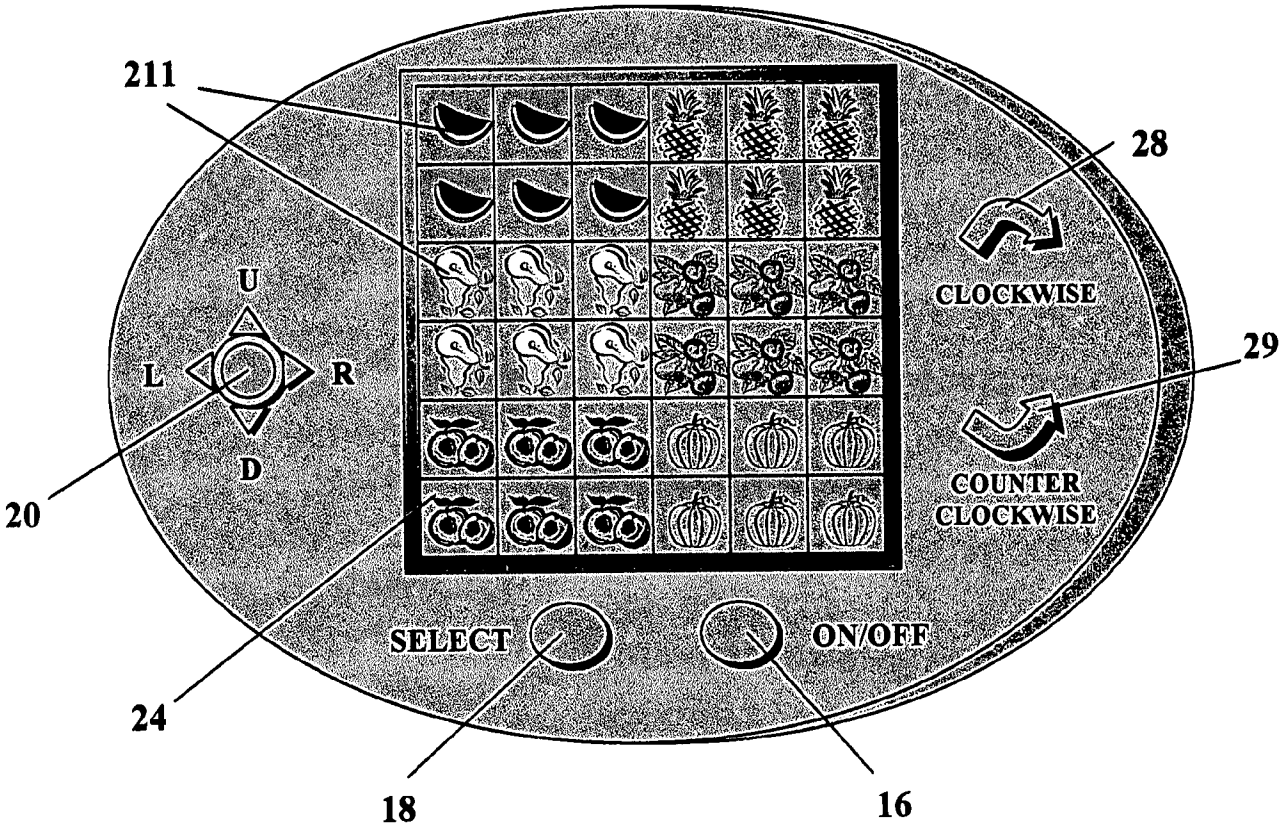
FIG. 5 is a perspective view of a preferred embodiment of a puzzle device according to the invention, employing an LCD screen that provides a 6×6 array of indicators.

FIGS. 3, 4 & 5 are perspective views of preferred embodiments of an electronic hand-held puzzle device that employs a two-dimensional array of indicators. The size of said two-dimensional array of indicators is a design choice, however, for illustration purposes FIG. 3 indicates a puzzle device that employs a 4×4 array of LED indicators; FIG. 4 shows a puzzle device using a 2×2 array of LED indicators, and configured as a key chain; and FIG. 5 indicates a puzzle device using an LCD screen subdivided into 6×6 playing positions. Each indicator in these devices has a plurality of indicating states, and is capable of providing a visual representation of any of said plurality of indicating states. The device shown in FIG. 3 operates with four (4) indicating states; the device shown in FIG. 4 operates with either two or four indicating states, and the device shown in FIG. 5 has six (6) indicating states.

The maximum number of different visual indications (colors or images) provided by these two-dimensional devices is a design choice. However, for the embodiments illustrated in FIGS. 3 & 4, the number of colors provided is four, and for the device indicated in FIG. 5, the maximum number of images is six. Similar to the cube and sphere devices, colors could be provided with or without an illuminated visual indication. When using an unilluminated color, the specific color presented to the player is the color reflected from the surface of an indicator. Similarly, one of the six indicating states in the 6×6 embodiment could be represented by the absence of an image at a playing position on the LCD screen. In such a case, a "blank" image is considered a visual indication, and one objective of a game could be to reach a game state when the entire LCD screen is empty.

The specific colors used for the devices shown in FIGS. 3 & 4 are red, green, yellow, and white. The white color is unilluminated, and is produced when the LED at a playing position is dark 116. To provide such multi-color indications, it is desirable to employ either RGB or bi-color LEDs as described for the cube and sphere devices.

The LCD screen 24 for the preferred embodiment shown in FIG. 5 could be monochromic or colored. However, for the purposes of describing this preferred embodiment, a colored screen is used. The specific type of screen used is a design choice. As would be appreciated by a person of ordinary skills in the art, Plasma, DLP, or any other type of colored screens could be used. It is also preferable to provide backlighting for the screen. The specific visual indications provided by this embodiment are also a design choice. Any six images that are distinguishable from each other, either in color or shape, could be used. For the purpose of describing this preferred embodiment, the visual indications used consist of six images of different fruits depicted in their natural colors 211.

Figure 18:
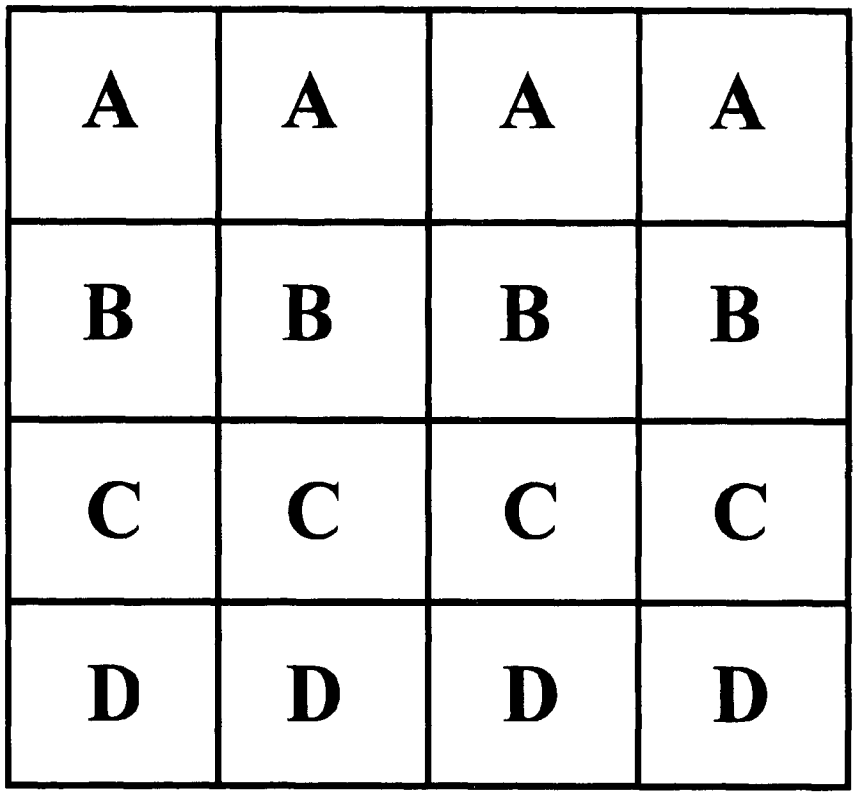
FIG. 18 is an example of a sector configuration for a 4×4 embodiment, using 4 sectors: A, B, C & D.
Figure 20:
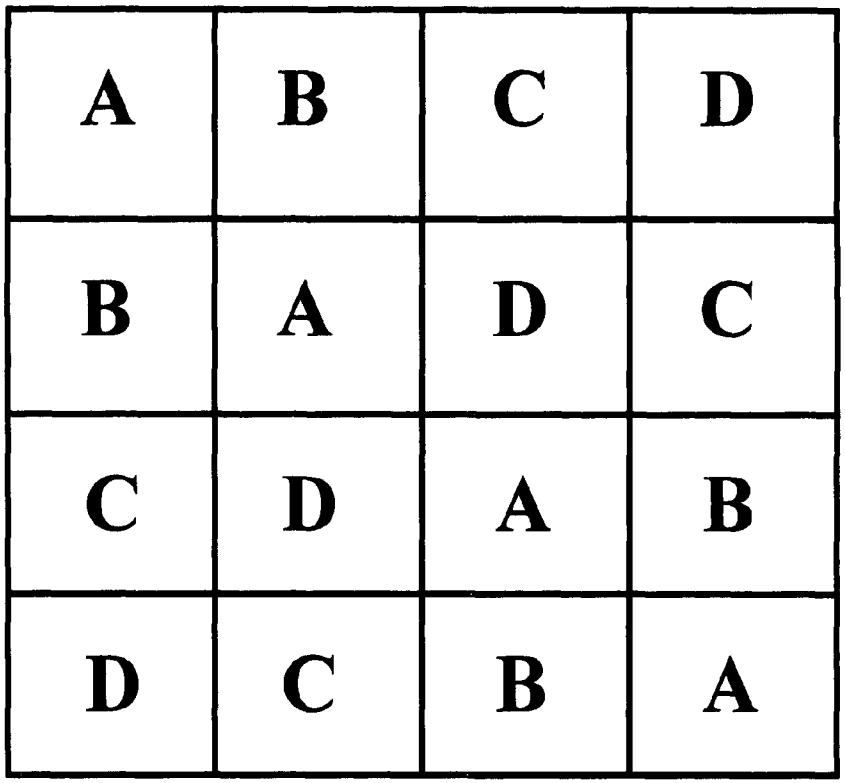
FIG. 20 is an example of a second alternate sector configuration for a 4×4 embodiment, using 4 sectors: A, B, C & D.

The playfield for the 4×4 embodiment shown in FIG. 3 is divided into four (4) sectors, each of which includes four (4) indicators. The configuration of the sectors is a design choice. FIGS. 18, 19 & 20 provide three alternate sector configurations, i.e., three alternate configurations of mapping sixteen (16) playing positions into four (4) sectors. In the first configuration, indicated in FIG. 18, each sector maps one row of the playfield. In the second configuration shown in FIG. 19, each sector maps one quadrant of the playfield. The third configuration indicated in FIG. 20 is based an assignment wherein two sectors maps the indicators on the two diagonals of the playfield, and the remaining two sectors map disjointed remaining playing positions on the playfield. As would be appreciated by a person of ordinary skills in the art, there are many thousands of possible sector configurations that could be defined by mapping the sixteen playing positions into four sectors.

Figure 15:
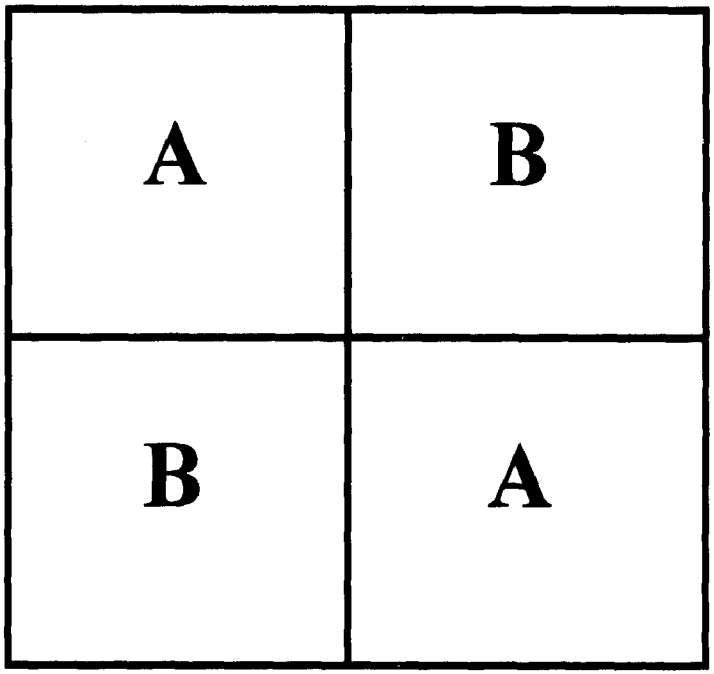
FIG. 15 is an example of a sector configuration for a 2×2 embodiment, using 2 sectors: A & B.
Figure 16:
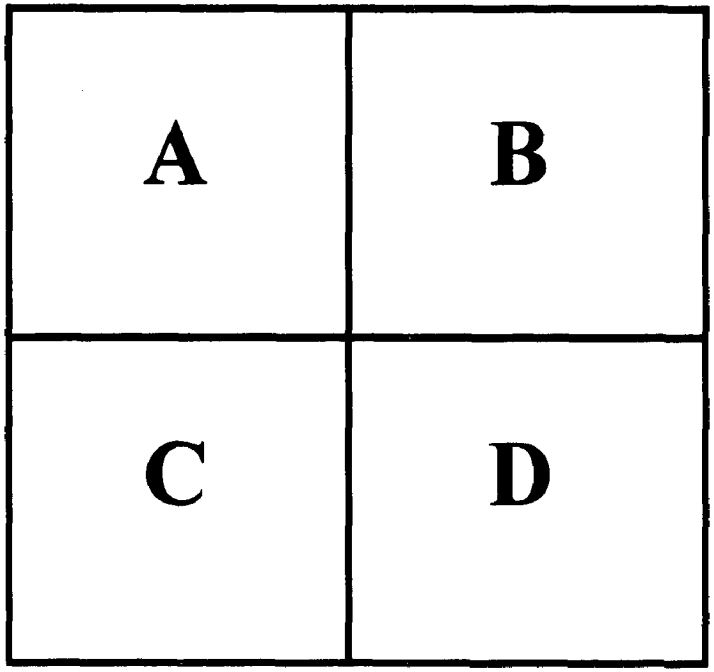
FIG. 16 is an alternate a sector configuration for a 2×2 embodiment, using 4 sectors: A, B, C & D.
Figure 17:
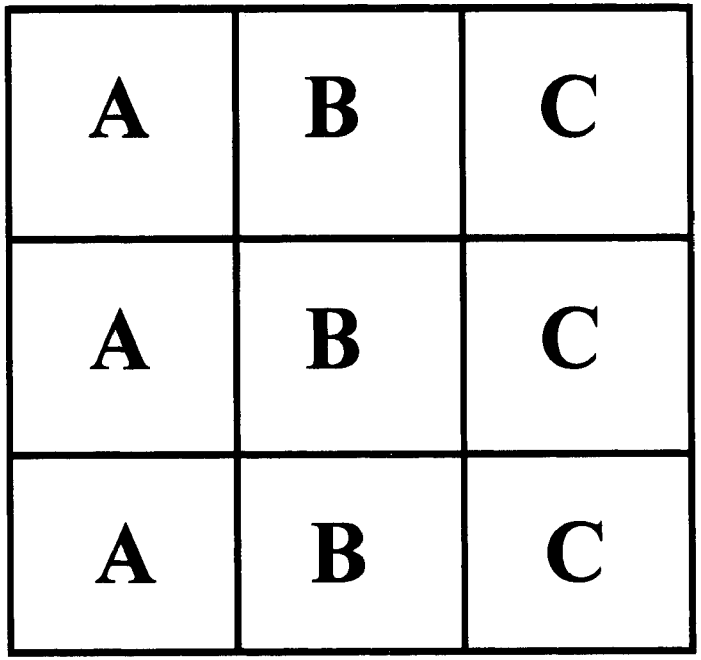
FIG. 17 is an example of a sector configuration for a 3×3 embodiment, using 3 sectors: A, B & C.
Figure 22:
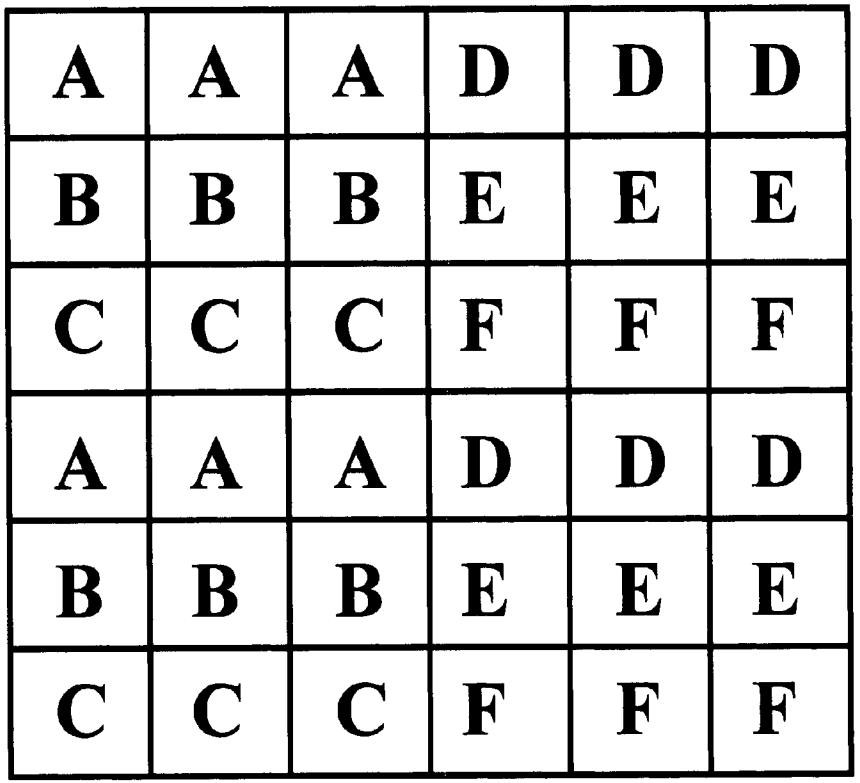
FIG. 22 is an example of a sector configuration for a 6×6 embodiment, using 6 sectors: A, B, C, D, E & F.

The playfield for the 2×2 embodiment shown in FIG. 4 could be divided into two or four sectors as indicated in FIGS. 15 & 16. In this embodiment the number of sectors is a game parameter selectable by the player. With respect to the 6×6 embodiment shown in FIG. 5, its playfield is divided into six (6) sectors as indicated in FIG. 22.

Similar to the cube and sphere devices, the number of indicating states for each indicator is a design choice. The 4×4 embodiment shown in FIG. 3 employs four (4) indicating states per indicator. For this preferred embodiment, when an indicating state is shifted or rotated from one sector to another sector, it provides a different visual indication, i.e. a different color or image, in accordance with the visual indication chart shown in FIG. 8. It should be noted that other embodiments could employ a structure that provides the same visual indication when an indicating state is shifted from one sector to another. It should also be noted that, even though there are three (3) alternate sector configurations for the 4×4 embodiment, the device employs the same visual indication chart for all three configurations.

The control circuits for the devices indicated in FIGS. 3 & 4 are based on the block diagram shown in FIG. 34. Similarly, the control circuit for the 6×6 LCD device indicated in FIG. 5 is based on the block diagram shown in FIG. 33.

Figure 6:
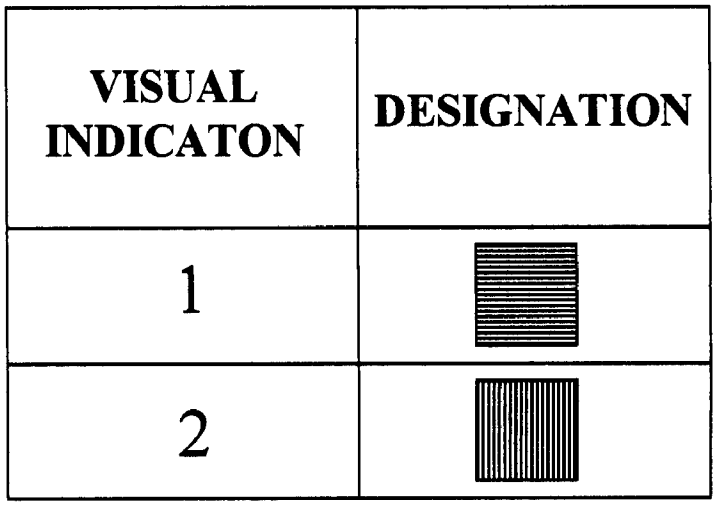
FIG. 6 is a visual indication chart in the form of a lookup table that describes the relationship between two visual indications (colors or images), two sectors, and two indicating states.
Figure 6:
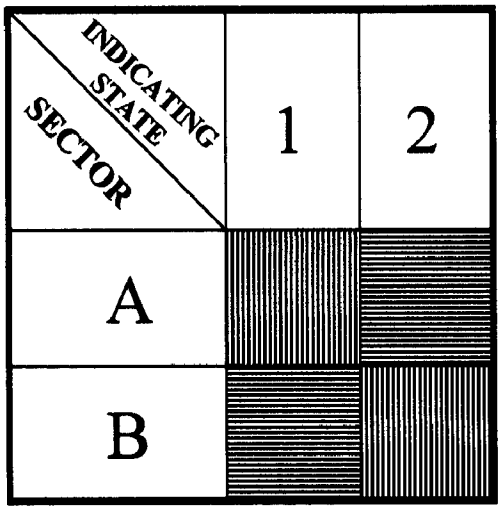
Figure 7:
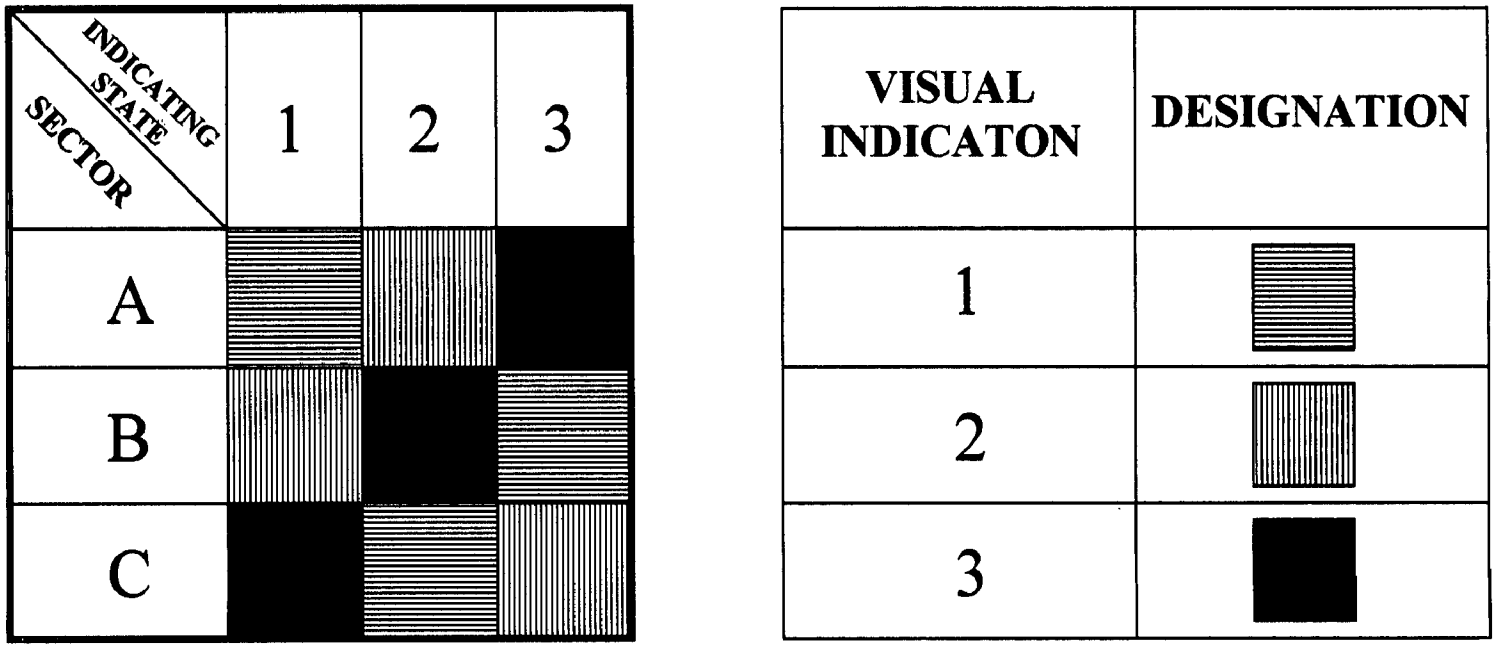
FIG. 7 is a visual indication chart in the form of a lookup table that describes the relationship between three visual indications (colors or images), three sectors, and three indicating states.

The 2×2 embodiment shown in FIG. 4 provides diverse puzzles that are based on different number of indicating states per indicator, namely either two or four indicating states. The player can select the number of indicating states at the beginning of a game. This preferred embodiment employs the two visual indication charts shown in FIGS. 6 & 8, depending on the number of sectors and indicating states selected by the player. Obviously, each indicator in this embodiment is capable of providing four different visual indications. When the player selects a puzzle that employs two indicating states, the device activates only two of the four visual indications during game play.

The 6×6 embodiment shown in FIG. 5 employs six indicating states per indicator. In this embodiment an indicator is defined as an indicating segment of the LCD screen. Each indicating state is represented by a different fruit image. This preferred embodiment employs the visual indication chart shown in FIG. 12.

It should be noted that additional embodiments could be implemented using 3×3, 5×5, 7×7, 8×8, or any other two-dimensional array of indicators. The main factors that determine how the visual indications are produced include the number of sectors, and the number of indicating states. It should, also, be noted that the number of sectors used is independent of the size of the two-dimensional playfield. Similarly, the number of indicating states is independent of the size of the playfield. Further, the number of sectors is independent of the number of indicating states. For example, a puzzle in an 8×8 embodiment could employ four sectors and two indicating states, and a 2×2 embodiment could employ four sectors and four indicating states. What governs the operation of a particular puzzle in a particular embodiment is the visual indication chart. Examples of sector configurations for 3×3, 5×5, 7×7, and 8×8 embodiments are indicated in FIGS. 17, 21, 23 & 24. Further, examples of visual indication charts for 3 sectors/3 indicating states, 5 sectors/5 indicating states, 7 sectors/7 indicating states, and 8 sectors/8 indicating states are shown in FIGS. 7, 11, 13 & 14.

The preferred embodiments shown in FIGS. 3, 4 & 5 employ diverse rotation patterns. The specific rotation pattern or patterns used for a two-dimensional playfield is a design choice. However, for the purpose of defining these preferred embodiments, a number of rotation patterns are illustrated. For the 2×2 embodiment there are four (4) rotation patterns that map the two columns & two rows in the playfield. Each of these rotation patterns maps two indicators. Similarly, the 4×4 embodiment employs eight (8) rotation patterns that map the four columns & four rows in the playfield. Each of those rotation patterns maps four indicators. A rotation pattern that maps a column, or a row incorporates a wraparound feature. The indicating states associated with indicators on a particular column or row are rotated or shifted in the direction of rotation. A rotation pattern that maps a column is rotated "UP" or "DOWN." When a column is shifter "UP," the wraparound feature shifts the indicating state associated with the top playing position of the column to its bottom playing position. Similarly, a rotation pattern that maps a row is rotated "LEFT" or "RIGHT." When a row is shifted to the "LEFT," the indicating state associated with the extreme left playing position is shifted to the extreme right playing position of the row.

Figure 25:
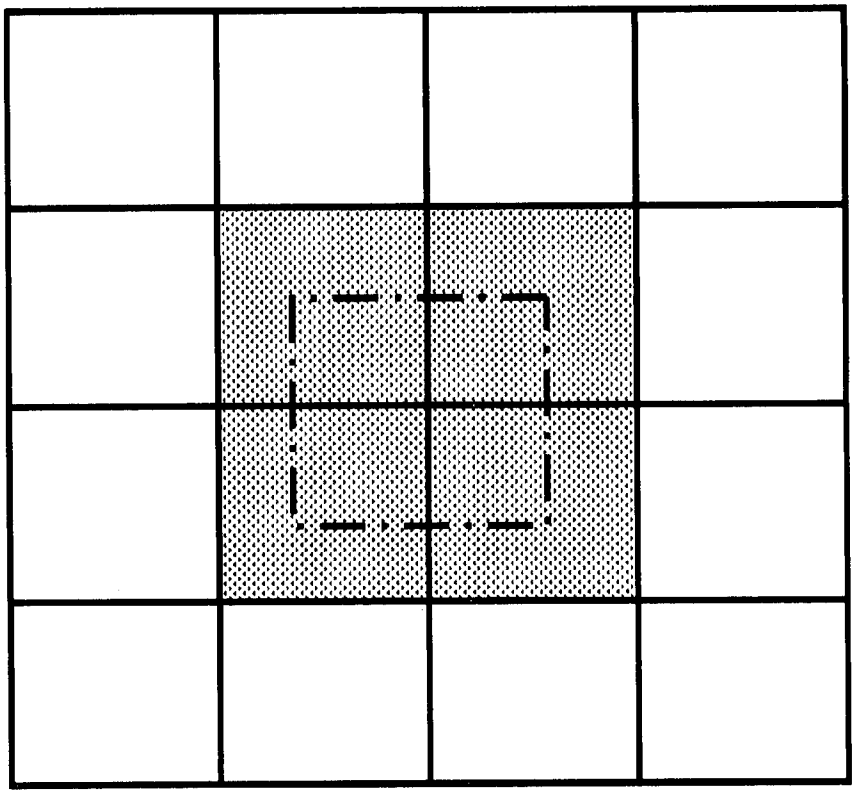
FIG. 25 is an example of a square rotation pattern, indicating four (4) associated playing positions.
Figure 26:
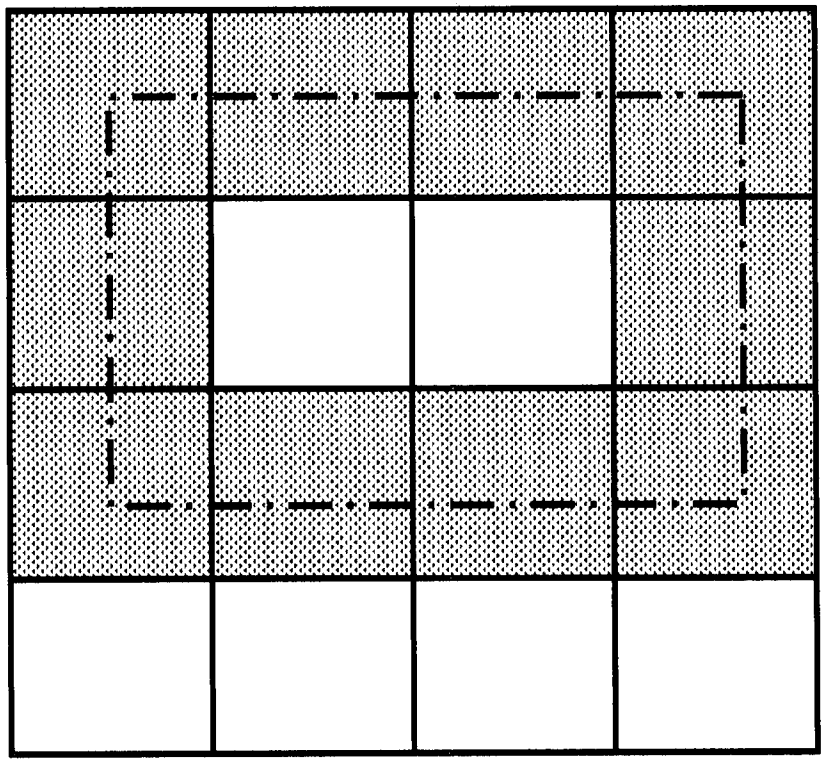
FIG. 26 is an example of a rectangular rotation pattern, indicating ten (10) associated playing positions.
Figure 27:
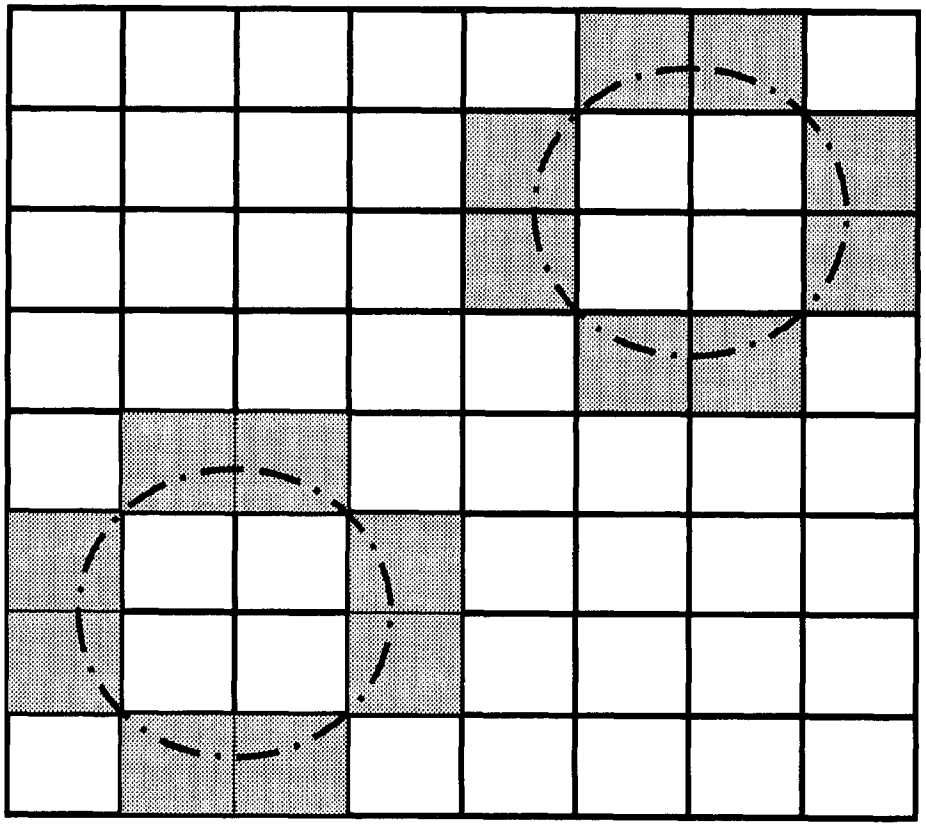
FIG. 27 provides two examples of circular square rotation patterns, each of which maps eight (8) playing positions.
Figure 28:
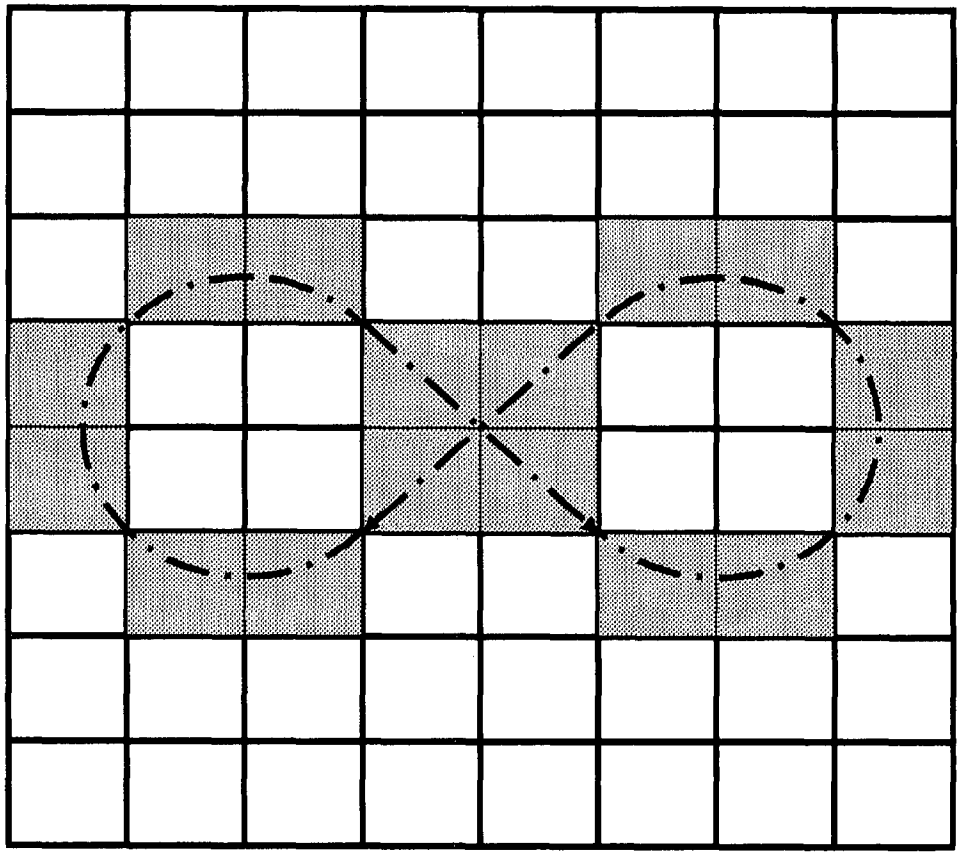
FIG. 28 is an example of a figure eight rotation pattern, indicating sixteen (16) associated playing positions.

Alternate rotation patterns consist of intersecting geometric shapes, each of which maps a plurality of playing positions on the two-dimensional playfield. Examples of such rotation patterns include square (FIG. 25), rectangle (FIG. 26), triangle, circle (FIG. 27), figure eight (FIG. 28), hexagonal, star, or any other geometric shape. Other shapes could also be used including free form or unique shapes designed by a game developer.

Figure 29:
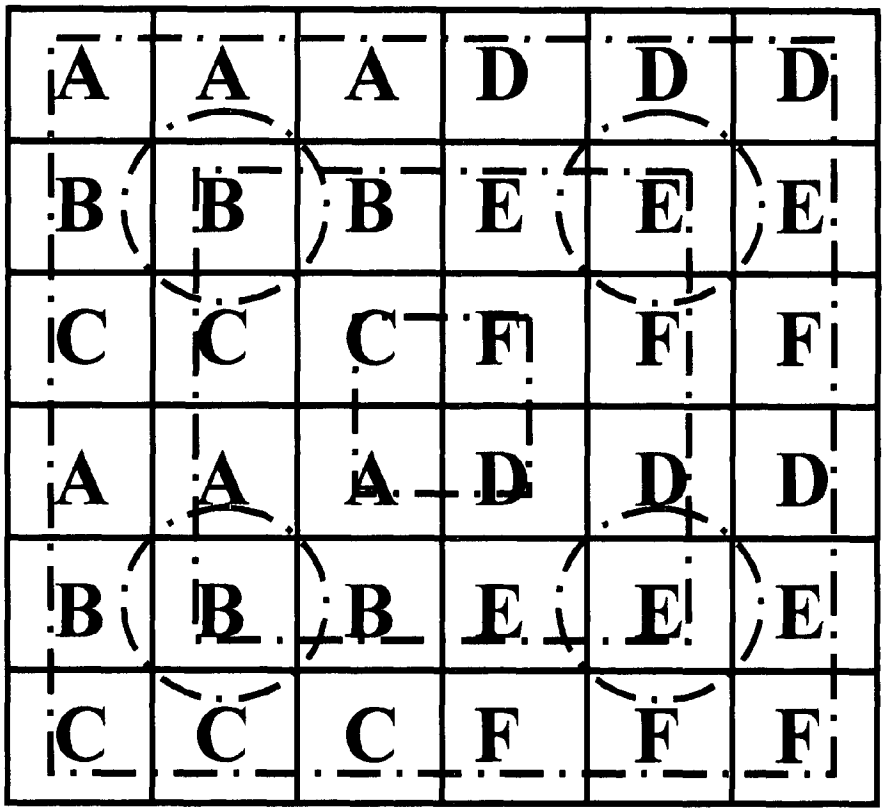
FIG. 29 shows a rotation patterns configuration for a 6×6 embodiment.
Figure 32:
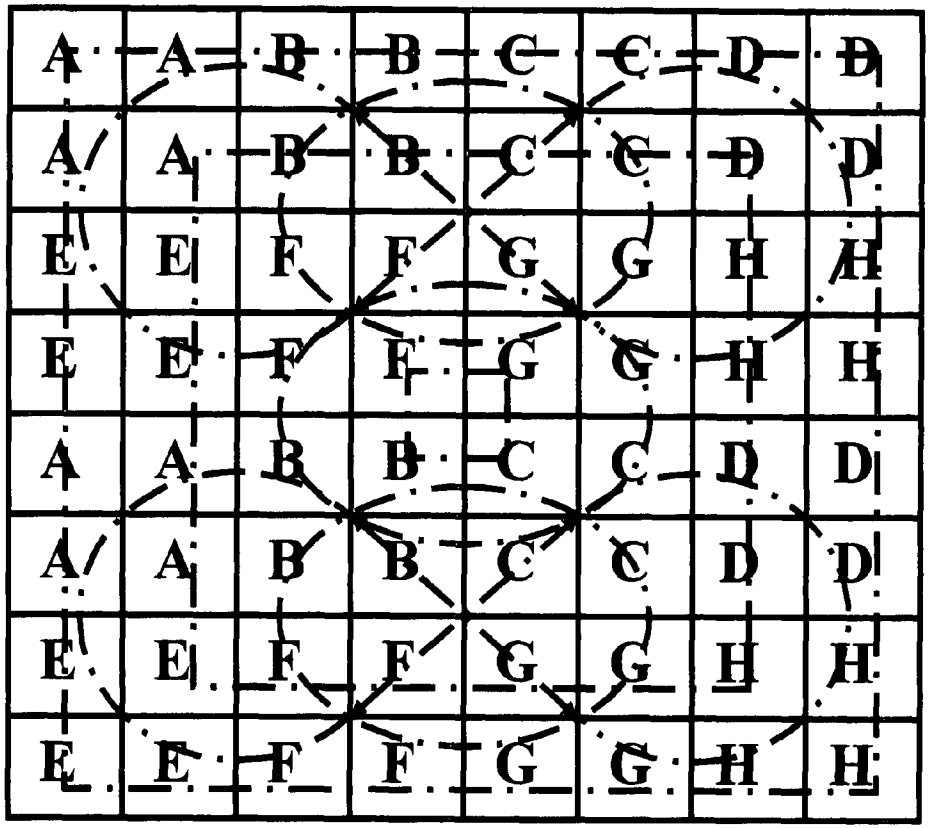
FIG. 32 is a rotation pattern configuration set for an 8×8 embodiment, indicating the use of figure-eight rotation patterns.

The 6×6 LCD device shown in FIG. 5 employs a plurality of sets of configuration patterns. At the beginning of a game, a player is requested to select one of said plurality of sets as one of the parameters that defines a puzzle FIG. 29 provides an example of a rotation patterns set. Also, FIG. 32 provides a second example of a rotation patterns set for an 8×8 embodiment. Upon a selection by the player of a specific set, the LCD display will provide a graphical representation of the selected set, indicating the various playing positions that map each rotation pattern included in the set, and the playing positions at which the various rotation patterns intersect. To activate a rotation pattern during game play, the player is provided with a mouse control mechanism 20 with a cursor and two switches 28 & 29. One of the switches is used to rotate a rotation pattern clockwise 28, and the second switch is used to rotate said pattern counter clockwise 29. The player is instructed to place the cursor on the desired rotation pattern, and then activate the appropriate switch depending on the desired rotation direction.

With respect to the devices shown in FIGS. 3 & 4, and in order to activate the rotation function for a particular rotation pattern, the player is provided with a switch mechanism similar to that used for the cube device 159, i.e., having a sliding action in each of the four directions of rotation, up, right, down and left. A switch mechanism for a specific row or column employs interconnected pieces that form a strip, and includes two momentary switches, each of which corresponds to a rotation direction. This mechanical configuration enables a player to activate the switch mechanism from any playing position on a row or a column.

As would be appreciated by a person of ordinary skills in the art, there are numerous embodiments, puzzles, and/or games that could be implemented using the concepts disclosed herein. The design parameters that define an embodiment and/or puzzle include the shape of the housing, the number of playing positions, the number and configuration of sectors, the number of indicating states, the visual indication chart(s) employed, and the number and configuration of rotation patterns. Further, the design parameters that define a game for a particular puzzle include the objective of the game, and the initial assignment of indicating states to playing positions. Additional features such as sound effects, means to vary the level of difficulty of play, a scoring system to measure a player's skill in solving various puzzles, etc., could also be incorporated in the various embodiments.

In addition, the puzzles and/or games described herein could be provided as a computer game on a CD, as a video game, or as a game on a hand held consumer electronic device.

Figure 35:
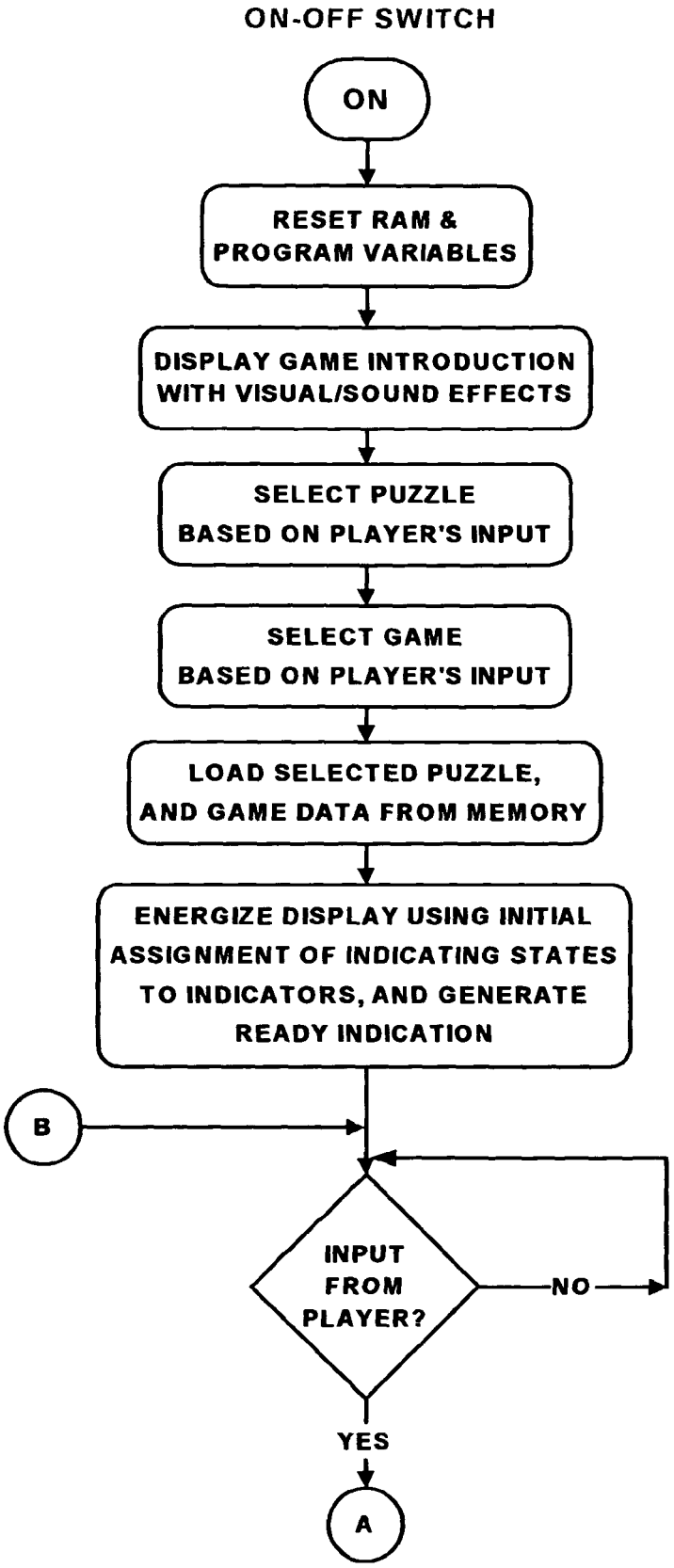
FIGS. 35 & 36 are logical flow diagrams illustrating the generic main program functions performed by the microprocessor controlling the operation of a game according to the invention.
Figure 36:
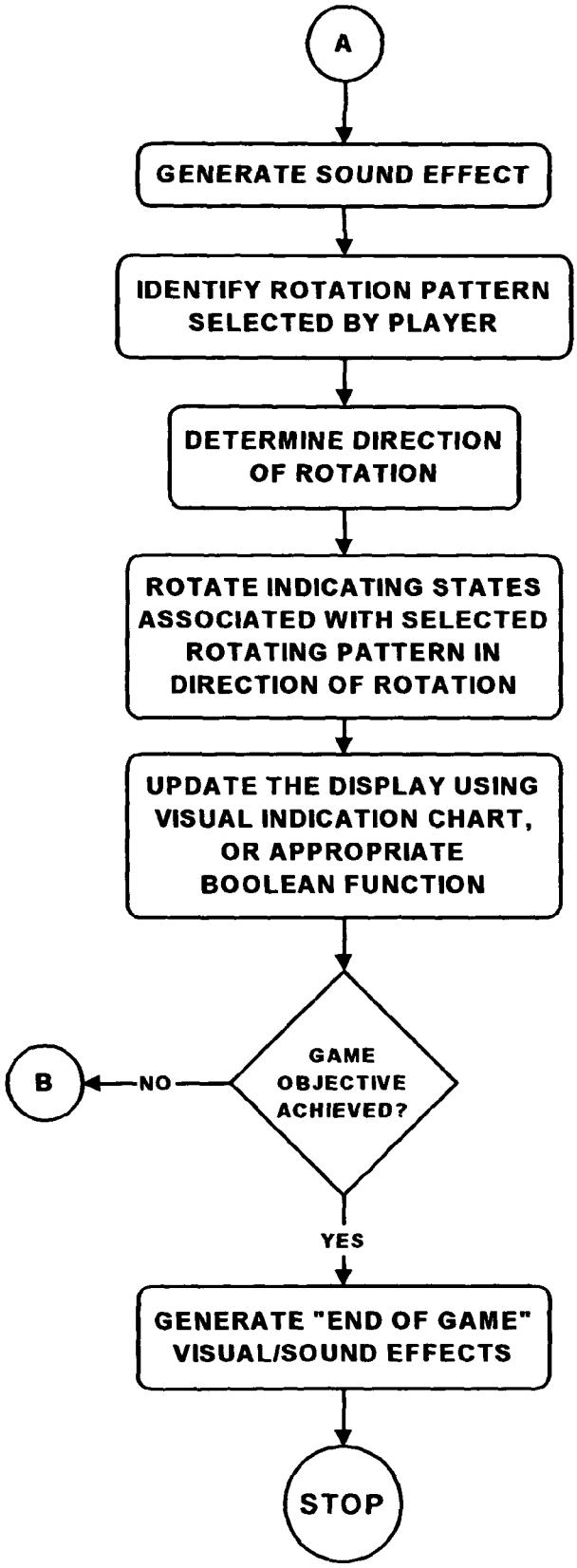

With respect to the operation of any of the devices shown in FIGS. 1, 2, 3, 4 & 5, the logic steps utilized are illustrated in the generic flow diagram form in FIGS. 35 & 36, which interconnect with each other at the places shown in the various figures. Even though specific reference will not be made to this diagram in the following description of the operation of a device, periodic reference to this diagram may prove to be helpful to the reader hereof. It should be noted that this generic flow diagram includes features that may not be present in all of the devices shown in FIGS. 1, 2, 3, 4 & 5. These features are optional, and it would be a design choice for a game designer to include them in a specific embodiment.

Referring again to FIG. 35, in order to operate a device, the player activates the on/off switch 16, which causes power to be supplied to all terminals of the device 10 from either a battery 62 or some external power source, and which causes a pulse generator 64 to generate a reset pulse. This pulse is applied to the central processing unit 60 and causes the central processing unit 60 to clear any data remaining in the RAM 64 and in the audio, and LED or LCD drivers 58 & 54 over the common data bus 90. The pulse also causes the central processing unit 60 to initiate a game introduction display that includes sound and visual effects. As would be obvious to a person of ordinary skills in the art, design provisions could be made to allow a player to continue playing a previous game when the device is first turned on. Under such implementation, current game data is stored in memory when the device is turned "OFF," and is restored when the device is turned back "ON."

The control program also determines the particular puzzle and game selected by the player, based on the specific preferred embodiment. The control program first determines the number and configuration of sectors using game data stored in a data section of the control program, and player input in embodiments where the number and configuration of sectors is a selectable parameter by the player. The control program next determines the number of indicating states for the selected puzzle. The number of indicating states is determined either based on game data stored in program memory, or from player's input. Next the control program selects a visual indication chart based on the number of sectors, number of indicating states, and the number of visual indications per indicator provided by the preferred embodiment for the selected puzzle. Next, the control program identifies the rotation patterns for the selected puzzle using program data, and player input in embodiments where the configuration of rotation patterns is a game parameter selectable by the player.

After determining the parameters for the selected puzzle, the control program selects a game for the puzzle, either based on player's input, or randomly from a plurality of games stored in the memory of the device. A game is defined by an initial assignment of indicating states to playing positions, and a game objective.

Upon determining the parameters for the selected puzzle and game, the microprocessor under the direction of the control program activates the indicators at the playing positions using the initial assignment of indicating states for the selected game. The control program then provides an indication to the player that game play is ready. Such indication could be audible and/or visual.

The microprocessor then awaits an input from the player. Upon receiving such input from the player, the control program determines the selected rotation pattern, and the selected direction of rotation. The control program then shifts the indicating states of the indicators associated with the selected rotation pattern by one playing position in the selected direction of rotation. Next, the control program determines the new visual indications at affected indicators using the visual indication chart for the selected puzzle. It should be noted that the control program could employ an appropriate Boolean function, or appropriate Boolean functions, to calculate display codes corresponding to the new visual indications at the indicators.

The microprocessor then updates the displays at affected indicators, and makes a determination if the objective of the game is met. If the player is successful in completing the objective of the game, then the microprocessor, under the direction of the control program, will generate "end of game" visual and/or sound effects. Alternatively, if the objective of the game is not reached, then the microprocessor will generate an audible signal and will await another input from the player. The foregoing process is repeated until the player succeeds in solving the puzzle.

As would be understood by those skilled in the art, many different programs may be utilized to implement the flow charts disclosed in FIGS. 35, 36, 37 & 38. Obviously these programs will vary from one another in some degree. However, it is well within the skill of a computer programmer to provide particular programs for implementing each of the steps of the flow charts disclosed herein. It is also to be understood that the foregoing detailed description has been given for clearness of understanding only and is intended to be exemplary of the invention while not limiting the invention to the exact embodiments shown. Obviously certain modifications, variations and improvements will occur to those skilled in the art upon reading the foregoing. It is, therefore, to be understood that all such modifications, variations and improvements have been deleted herein for the sake of conciseness and readability, but are properly within the scope and spirit of the following claims.

What is claimed and desired to be secured by Letters of Patent is:

1. An electronic game device comprising a playfield that is subdivided into a plurality of sectors, wherein each sector includes one or more playing positions, wherein each playing position includes an indicator that provides a plurality of visual indications, and wherein each of said visual indications corresponds to one or a plurality of indicating states, a microprocessor with a non transitory computer-readable medium encoded with a computer program, when executed by the microprocessor to control the operation of the device, a plurality of rotation patterns defined on the surface of the playfield, wherein each of said rotation pattern has at least one direction of rotation, and maps a plurality of indicators, a plurality of switches to enable a player to activate the rotation patterns, a computer program segment that, upon the activation of a rotation pattern, causes the indicating states of the indicators associated with said pattern to shift to new indicators along the rotation pattern, and a computer program segment that calculates new visual indications at the indicators affected by the activation of the rotation pattern, and wherein said new visual indications are based on the combination of indicating state and sector.

2. An electronic game device as recited in claim 1 further comprising a housing for the device.

3. An electronic game device as recited in claim 2 wherein an indicator is implemented using light-emitting means.

4. An electronic game device as recited in claim 3 wherein the light emitting means use multi-color Light Emitting Diodes.

5. An electronic game device as recited in claim 3 wherein the light emitting means provides at least one illuminated indication, and one unilluminated indication.

6. An electronic game device as recited in claim 2, wherein said plurality of playing positions is provided by an LCD screen.

7. An electronic game device as recited in claim 6, wherein said LCD screen is of the monochromic type.

8. An electronic game device as recited in claim 6, wherein said LCD screen is colored.

9. An electronic game device as recited in claim 2, wherein said plurality of playing positions are in the form of a two-dimensional array of playing positions.

10. An electronic game device as recited in claim 9, wherein the rotation patterns include at least one of a square, rectangle, circle, triangle, and figure eight shape.

11. An electronic game device as recited in claim 9, wherein rotation patterns map columns and rows of indicators with a wraparound feature.

12. An electronic game device as recited in claim 2, wherein said plurality of playing positions is mapped on the surface of a three-dimensional housing.

13. An electronic game device as recited in claim 12, wherein the shape of said three-dimensional housing is in the form of a cube.

14. An electronic game device as recited in claim 13, wherein rotation patterns map perimeter strips of indicators.

15. An electronic game device as recited in claim 13, wherein each face of the cube represents a different sector.

16. An electronic game device as recited in claim 12, wherein the shape of said three-dimensional housing is in the form of a sphere.

17. An electronic game device as recited in claim 16, wherein rotation patterns map rings of indicators.

18. An electronic game device as recited in claim 1, wherein an indicating state is shifted by one position for each activation of the rotation pattern.

19. An electronic game device as recited in claim 1, wherein an indicating state is shifted by a plurality of positions for each activation of the rotation pattern.

20. An electronic game device as recited in claim 1, wherein the indicators are implemented using audible means.

21. An electronic game device comprising:

a playfield that includes a plurality of sectors, each of which includes at least one indicator that provides a plurality of visual indications, wherein each of said visual indications corresponds to one or a plurality of indicating states, a microprocessor with a non-transitory computer-readable medium encoded with a computer program, when executed by the microprocessor to control the operation of the device, a computer program segment that rotates indicating states between indicators on the playfield, a plurality of input control mechanisms to enable a player to activate a rotation pattern, a computer program segment that determines which indicators were affected by the activation of a rotation pattern, and a computer program segment that determines new visual indications at affected indicators.

22. An electronic game device as recited in claim 21, further comprising a housing.

23. An electronic game device as recited in claim 22, wherein an indicator is implemented using light emitting means.

24. An electronic game device as recited in claim 22, wherein said plurality of playing positions is provided by an LCD screen.

25. An electronic game device as recited in claim 22, wherein said plurality of playing positions is in the form of a two-dimensional array of playing positions.

26. An electronic game device as recited in claim 22, wherein said plurality of playing positions is mapped on the surface of a three-dimensional housing.

27. An electronic game device as recited in claim 21 wherein an indicating state is shifted by one position for each activation of the rotation pattern.

28. An electronic game device as recited in claim 21, wherein an indicating state is shifted by a plurality of positions for each activation of the rotation pattern.

29. An electronic game device as recited in claim 21, wherein said computer program segment that rotates indicating states between indicators on the playfield includes rotating said indicating states along predetermined rotation patterns on the playfield.

30. An electronic game device comprising:

a housing, a playfield that includes a plurality of sectors, each of which has one or more playing positions, wherein each playing position includes an indicator that provides a plurality of visual indications, wherein each visual indication corresponds to one or a plurality of indicating states, and wherein a visual indication at a playing position is determined by matching the indicating state at the playing position with the sector where the playing position is located, a microprocessor with a non-transitory computer-readable medium encoded with a computer program, when executed by the microprocessor to control the operation of the device, a plurality of rotation patterns defined on the surface of the playfield, wherein each of said rotation patterns has at least one rotation direction, and maps a plurality of indicators, a plurality of switches to enable a player to activate the rotation patterns, and a computer program segment, which upon the activation of a rotation pattern causes the indicating states of the indicators associated with the rotation pattern to shift to new indicators along the rotation pattern, and a computer program segment that calculates new visual indications for the indicators associated with the rotation pattern.

31. An electronic game device as recited in claim 30, wherein said plurality of switches includes at least one of a mechanical momentary switch, a mouse control mechanism with a momentary switch, and a touch screen control.

32. An electronic game device as recited in claim 31, wherein said touch screen control includes an algorithm that determines a direction of rotation based on a sliding touch action by the player.

33. An electronic game device as recited in claim 30, wherein said indicators are implemented using light emitting means.

34. An electronic game device as recited in claim 30, wherein said indicators are implemented using at least one monochromic or colored LCD screen.

35. An electronic game device comprising:

a housing, a playfield that is divided into a plurality of sectors, each of which includes at least one playing position, wherein each playing position includes an indicator that provides a plurality of visual indications, and wherein each visual indication corresponds to one or a plurality of indicating states, a microprocessor with a non-transitory computer-readable medium encoded with a computer program, when executed by the microprocessor to control the operation of the device, a plurality of rotation patterns defined on the surface of the playfield, wherein each of said rotation patterns has at least one rotation direction, and maps a plurality of sectors, a plurality of switches to enable a player to activate the rotation patterns, and a computer program segment, which upon the activation of a rotation pattern causes the indicating states of indicators associated with the rotation pattern to shift along the rotation pattern, and A computer program segment that determines the new visual indications at the indicators associated with the rotation pattern by matching the new indicating states with the sectors.

36. A method for an electronic puzzle having a playfield that is divided into a plurality of sectors, wherein each sector includes a plurality of playing positions, wherein each playing position includes an indicator that can provide a plurality of visual indications, and wherein each visual indication corresponds to one or a plurality of indicating states, comprising the steps of:

Assigning an indicating state to each indicator, defining a plurality of rotation patterns on the playfield, such that each rotation pattern maps a plurality of sectors, rotating the indicating states along the rotation patterns, and calculating new visual indications at the indicators by matching the indicating states with the sectors where the indicators are located.

* * * * *